US006989810B2

(12) United States Patent
Morita

(10) Patent No.: US 6,989,810 B2
(45) Date of Patent: Jan. 24, 2006

(54) LIQUID CRYSTAL DISPLAY AND DATA LATCH CIRCUIT

(75) Inventor: Tetsuo Morita, Konosu (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 197 days.

(21) Appl. No.: 09/865,498

(22) Filed: May 29, 2001

(65) Prior Publication Data

US 2002/0018039 A1 Feb. 14, 2002

(30) Foreign Application Priority Data

May 29, 2000 (JP) ..... 2000-158365
Dec. 20, 2000 (JP) ..... 2000-387063

(51) Int. Cl.
*G09G 3/36* (2006.01)

(52) U.S. Cl. ..... 345/98

(58) Field of Classification Search ..... 345/87–103; 341/26, 150, 105
See application file for complete search history.

(56) References Cited

U.S. PATENT DOCUMENTS 6,011,533 A * 1/2000 Aoki ..... 345/92
6,281,826 B1 * 8/2001 Kimura ..... 341/150
6,411,273 B1 * 6/2002 Nakamura et al. ..... 345/98
6,459,395 B1 * 10/2002 Kida et al. ..... 341/126
6,507,332 B1 * 1/2003 Kuwabara et al. ..... 345/103
6,750,835 B2 * 6/2004 Azami ..... 345/89

FOREIGN PATENT DOCUMENTS

JP 11-167373 6/1999

* cited by examiner

*Primary Examiner*—Sumati Lefkowitz
*Assistant Examiner*—Srilakshmi K Kumar
(74) *Attorney, Agent, or Firm*—Oblon, Spivak, McClelland, Maier & Neustadt, P.C.

(57) ABSTRACT

A liquid crystal display in which a structure of a signal line drive circuit can be simplified is provided.

The liquid crystal display according to the present invention includes sampling latch circuits, load latch circuits and D/A converters which are ⅙ of an aggregate number of signal lines, and drives every six signal lines for six times. As a result, a mounting area of a signal line drive circuit can be reduced. Further, after driving odd-numbered signal lines in a first half of a one-horizontal-line period, even-numbered signal lines are driven in a last half of the same. Therefore, V-inversion driving can be easily realized by only switching the polarity of an analog gradation voltage in the first half and the last half of the one-horizontal-line period. That is, since the number of times of switching the voltage polarity can be reduced, voltage control is facilitated, thereby hardly being influenced by noises. Furthermore, gradation power supply wirings for the positive polarity and gradation power supply wirings for the negative polarity required in the prior art, but the number of these wirings can be reduced by half, thereby decreasing a wiring area.

8 Claims, 20 Drawing Sheets

LIQUID CRYSTAL DISPLAY AND DATA LATCH CIRCUIT

CROSS REFERENCE TO RELATED APPLICATIONS

This application claims benefit of priority under 35USC § 119 to Japanese Patent Application No. 2000-158365, filed on May 29, 2000, the entire contents of which are incorporated by reference herein.

BACKGROUND OF THE INVENTION (i) Field of the Invention

The present invention relates to liquid crystal display for converting digital gradation data supplied from outside into an analog gradation voltage in an array substrate to drive signal lines and more particularly to a technique for forming a signal line drive circuit on an array substrate.

(ii) Description of the Related Art

In general, an active matrix type liquid crystal display has a liquid crystal layer sandwiched and sealed between an array substrate and an opposed substrate, The array substrate includes a plurality of pixel electrodes arranged in the matrix form, a plurality of scanning lines arranged in a line direction along these pixel electrodes, a plurality of signal lines arranged in a row direction along these pixel electrodes, and pixel TFTs arranged in the vicinity of an intersection of the signal lines and the scanning lines.

The pixel TFTs are turned on/off in accordance with a voltage of the scanning lines and, when the pixel TFT is turned on, the pixel TFT supplies a voltage of a corresponding signal line to a corresponding pixel electrode.

With advancement of the recent micro-fabrication technique, it is technically possible to form a scanning line drive circuit for driving the scanning lines and a signal line drive circuit for driving the signal lines on an array substrate.

FIG. 1 is a block diagram showing a schematic structure of a conventional digital liquid crystal display for driving the signal lines based on digital gradation data supplied from outside.

The liquid crystal display shown in FIG. 1 has an array substrate on which signal lines and scanning lines are aligned, a scanning line drive circuit for driving the scanning lines, and a signal line drive circuit for driving the signal lines.

The scanning line drive circuit has a vertical shift register for shifting a vertical scanning pulse based on a vertical synchronous signal supplied from outside of the array substrate.

As shown in FIG. 1, the signal line drive circuit is provided with a horizontal shift register 4, digital video bus lines L, sampling latch circuits 5, load latch circuits 6, and D/A converters 7.

Digital gradation data is supplied to the digital video bus lines L. This digital gradation data is latched to the sampling latch circuit 5 by a timing signal from the horizontal shift register 4.

A time required to latch the digital gradation data for one horizontal line by the sampling latch circuit 5 is referred to as a one-line period.

The load latch circuit 6 simultaneously latches data latched at timings different from each other by the respective sampling latch circuits 5. After the latch operation by the load latch circuit 6 is completed, the respective sampling latch circuits 5 sequentially perform the latch operation of subsequent horizontal lines.

When the sampling latch circuit 5 is carrying out the latch operation, the D/A converter 7 converts a digital gradation voltage into an analog gradation voltage with respect to the immediately preceding horizontal line. This analog gradation voltage is supplied to a corresponding signal line. By repeating the above-described operation, an image is displayed in all pixel display areas in the array substrate.

In case of the liquid crystal display adopting the digital gradation system shown in FIG. 1, since an area occupied by the sampling latch circuits 5, the load latch circuits 6 and the D/A converters 7 is very large, it is difficult to reduce size of the overall liquid crystal display.

In particular, the display resolution of the liquid crystal display tends to be gradually increased in recent years. However, in case of the structure shown in FIG. 1, since the number of the sampling latch circuits 5, the load latch circuits 6 and the D/A converters 7 must be also increased as the display resolution becomes higher, there is a problem that the display resolution can not be set too high.

FIG. 2 is a view showing a specific circuit structure of the sampling latch circuit 5. In this drawing, an input terminal (which will be referred to as a node A hereinafter) of a CMOS inverter 81 is connected to an output terminal of e CMOS inverter 82, and an output terminal (which will be referred to as a node B hereinafter) of the CMOS inverter 81 is connected to an input terminal of the CMOS inverter 82. These two inverters are connected to a negative power supply Vss via an NMOS transistor 83 and a positive power supply VDD via a PMOS transistor 84. These two inverters are connected in the loop shape and form a memory circuit 80 for storing a digital signal.

The digital gradation data is connected to the node A via an NMOS transistor 85, and /digital gradation data which is a reversed phase signal of the digital gradation data is connected to the node B via an NMOS transistor 86.

A timing signal from the shift register 11 is inputted to gates of the PMOS transistor 84 and the NMOS transistors 85 and 86, and a reversed phase signal of the timing signal is inputted to a gate of the NMOS transistor 83.

Further, a CMOS inverter 87 is connected to the node A and a CMOS inverter 88 is connected to the node B, respectively. An output from the CMOS inverter 87 is inputted to the load latch circuit 6.

The circuit operation of the sampling latch circuit 5 illustrated in FIG. 2 will now be described with reference to a timing chart of FIG. 3.

At a time t1, when the timing signal from the shift register 11 rises to a high level, the NHOS transistor 83 and the PMOS transistor 84 are turned off, and the NMOS transistor 85 and the NMOS transistor 86 are turned on so that the digital gradation data and the reversed phase data thereof are fetched to the node A and the node B, respectively.

Subsequently, at a time t2, when the timing signal from the shift register 11 falls to a low level, the NMOS transistor 85 and the NMOS transistor 86 are turned off, and the NMOS transistor 83 and the PMOS transistor 84 are turned on. As a result, input of the digital gradation data is interrupted, and the power supply voltage is supplied to the memory circuit 80. In the memory circuit 80, a voltage of the digital gradation data is compared with that of the reversed phase data in the node A and the node B, the level of the high potential (VHigh) is converted to VDD and the level of the low potential (VLow) is converted to VSS respectively.

The inverters 87 and 88 are inserted in order to equalize a parasitic capacitance of the node A and a parasitic capacitance of the node B. That is, as shown in FIG. 4, when only a signal on the node A side is supplied to the load latch circuit 6, there occurs a difference between the parasitic capacitance of the node A and the parasitic capacitance of the node B. Further, when level-converting the digital date at the time t2, a malfunction of the memory circuit 80 may possibly occur. Thus, an inverter which is a simplest CMOS circuit component is connected to each of the node A and the node B to equalize the parasitic capacitance of the node A and that of the node B.

An output of the inverter 87 connected to the node A is latched to the load latch circuit in a period from a time t3 to a time t4.

By adopting such a circuit structure as shown in FIG. 2, the voltage level of the digital gradation data supplied to the sampling latch circuit 5 can be set to a low voltage of 0 to 3 V. That is, the digital video bus line 12 can be driven with the low voltage, and the low power consumption can be realized. Furthermore, since the digital data can be directly inputted from the external timing 1C without using the level shift circuit, the structure of the system can be simplified.

However, in case of the liquid crystal display adopting the digital gradation system shown in FIGS. 2 and 3, when the timing signal from the shift register 11 rises to the high level (time t1 to time t2) and the digital gradation data is fetched into the memory 0 V and 3 V (or 3 V and 0 V) are fetched into the inverter 87 and the inverter 88, and all the NMOS and PMOS transistors constituting the inverters 87 and 88 are turned on. Consequently, a passing electric current flows from the power supply voltage terminal VDD toward a ground terminal VSS, and the electric current consumption of the sampling latch circuit 5 disadvantageously becomes large.

SUMMARY OF THE INVENTION

In view of the above-described problems, it is an object of the present invention to provide a liquid crystal display in which the structure of a signal line drive circuit can be simplified.

Further, it is another object of the present invention to provide a data latch circuit and a liquid crystal display which intend to reduce the power consumption by preventing a passing electric current from flowing.

To achieve this aim, the is provided a liquid crystal display comprising:

a pixel array portion having signal lines and scanning lines horizontally and vertically aligned, and pixel transistors formed in the vicinity of each intersection of said signal line and said scanning line;

a plurality of first latch circuits configured to latch digital gradation data consisting of a plurality of bits in different timings;

a plurality of second latch circuits which are provided in accordance with each of a plurality of said first latch circuits and latch date latched by each of a plurality of said first latch circuits at the same time;

a plurality of D/A Converters which are provided in accordance with each of a plurality of second latch circuits and convert latch data latched by each of a plurality of said second latch circuits into analog gradation voltage, and a signal line selection circuit configured to switch whether said analog gradation voltage is supplied to each signal line so that said signal lines in said pixel array portion are driven every multiple signal lines in multiple times.

According to the present invention, since the signal lines are driven by every multiple signal lines in multiple times, the number of the first latch circuits, the second latch circuits and the D/A converters can be reduced, and the structure of the signal line drive circuit can be simplified. Therefore, the signal line drive circuit can be easily formed on the same insulating substrate as the signal lines, the scanning lines, the pixel transistors and others.

Further, since level conversion of the externally inputted signal is carried out on the insulating substrate, it is unnecessary to conduct level conversion outside the insulating substrate. Furthermore since the voltage level of each signal can be set to a level optimum for the transistors on the insulating substrate, the operation of the signal line drive circuit 2 can be stabilized.

Moreover, since the analog gradation voltage is generated by only two types of voltages supplied from outside, it is unnecessary to supply various types of voltages from outside, thereby simplifying the structure of the overall liquid crystal display.

In addition, there is provided a data latch circuit comprising:

a memory circuit which has first and second inverters having one output terminal connected to the other input terminal and the other output terminal connected to one input terminal and stores therein digital data which is a latch target;

first and second switch devices configured to switch and controlling whether a power supply voltage is supplied to said first and second inverters;

a third switch device configured to switch and controlling whether said digital data is inputted to said memory circuit; and an output circuit configured to read digital data stored in said memory circuit, said first and second switch devices being turned on in a period other than a cyclic sampling period to supply a power supply voltage to said first and second inverters, said third switch device being turned on in said sampling period to input digital data to said memory circuit, said output circuit having a passing electric current prevention function so as not to cause a passing electric current to flow from a power supply terminal of said output terminal to a ground terminal in said sampling period.

Additionally, according to the present invention, since the output circuit of the data latch circuit has the passing electric current prevention function, the power consumption can be reduced in the sampling period. Therefore, when the present invention is applied to the liquid crystal display, the low power consumption type liquid crystal display can be realized.

Figure 5:
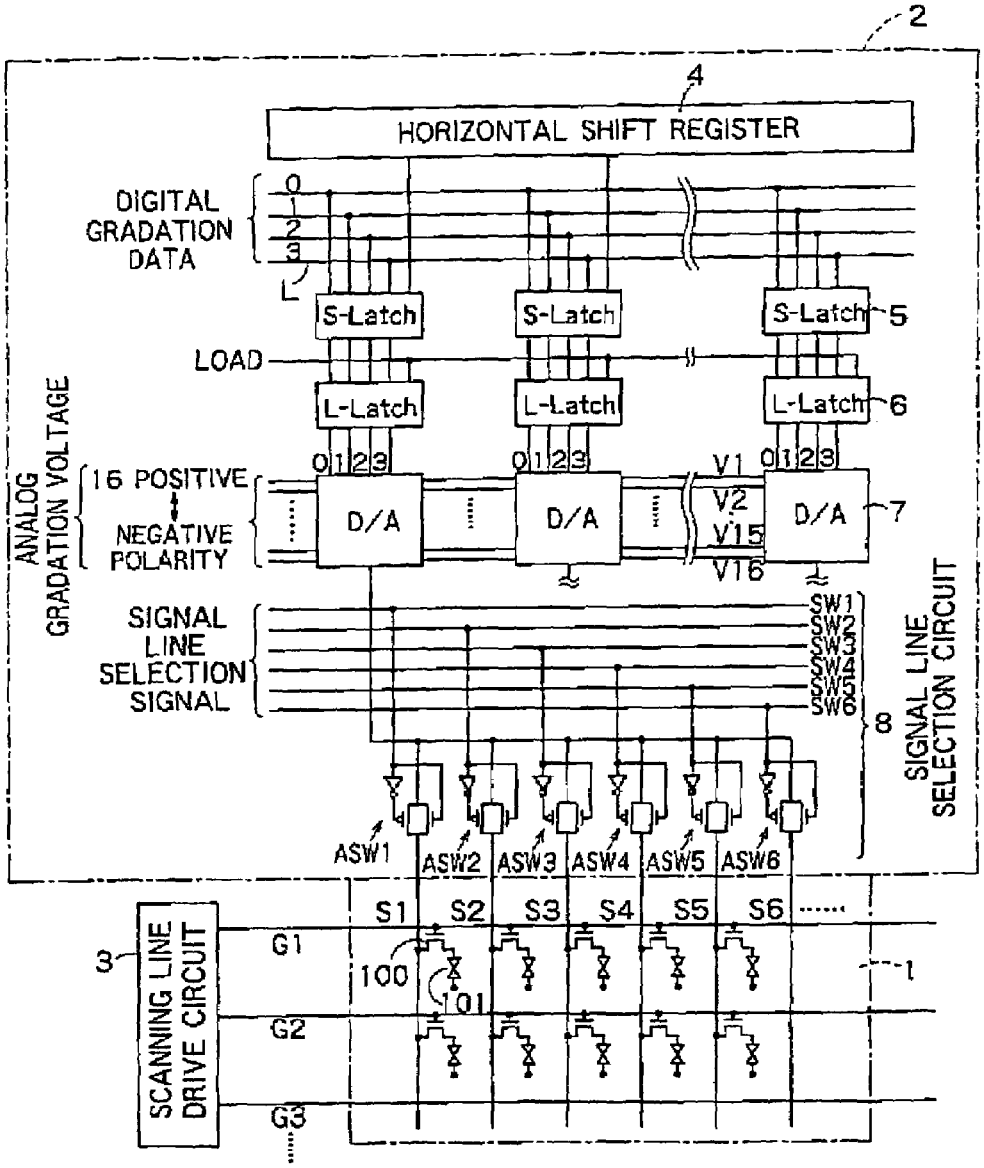
Figure 6A:
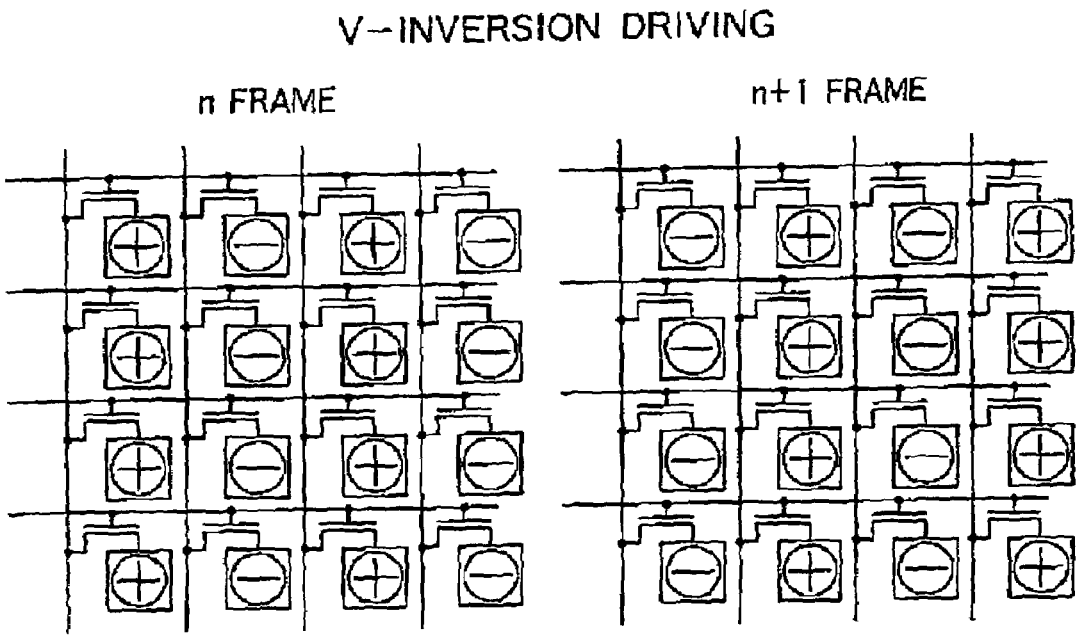
Figure 6B:
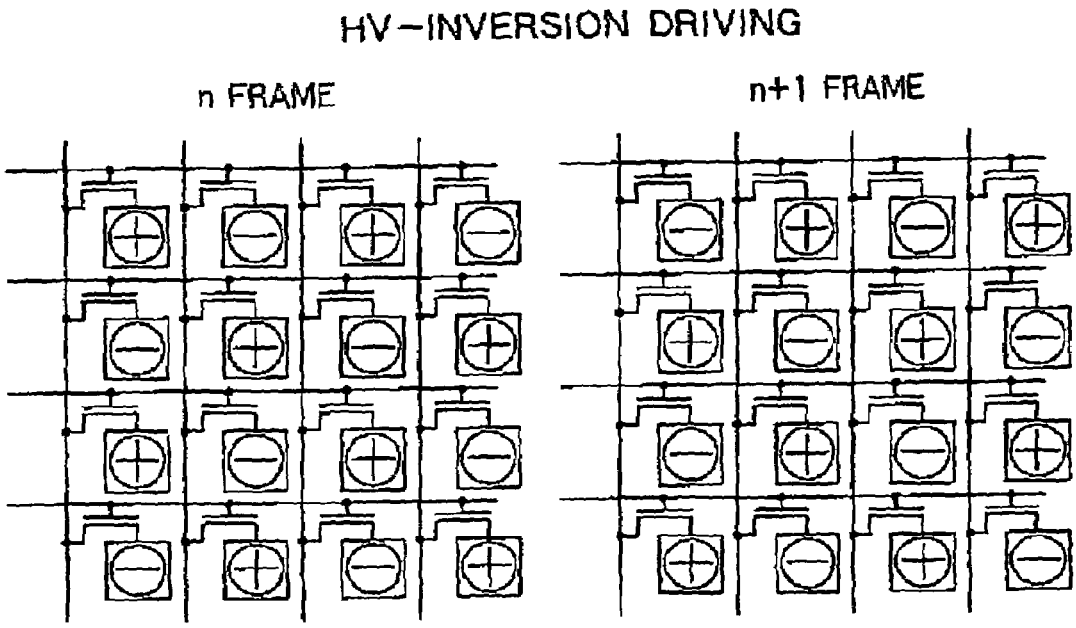
Figure 7:
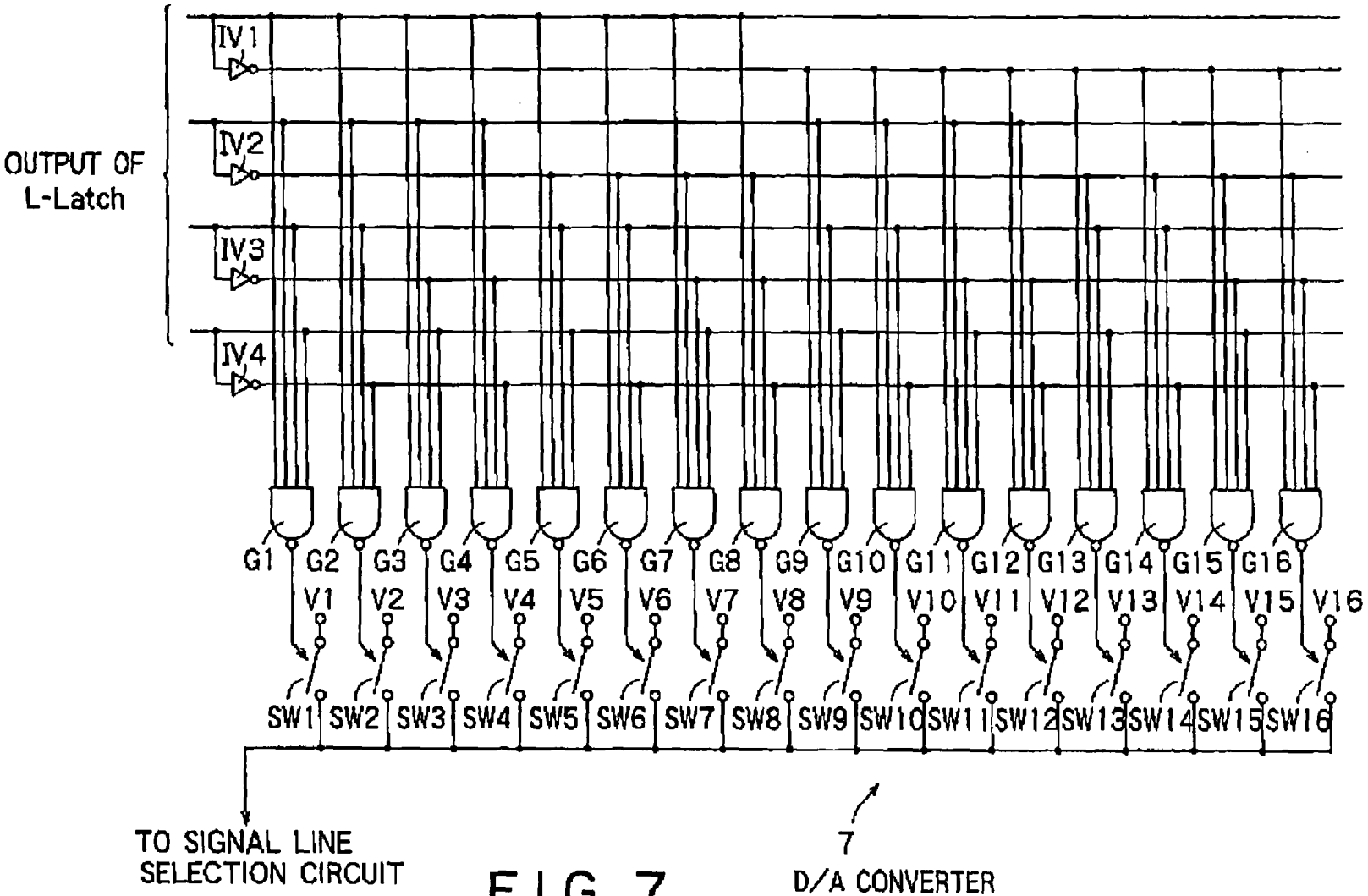
Figure 8:
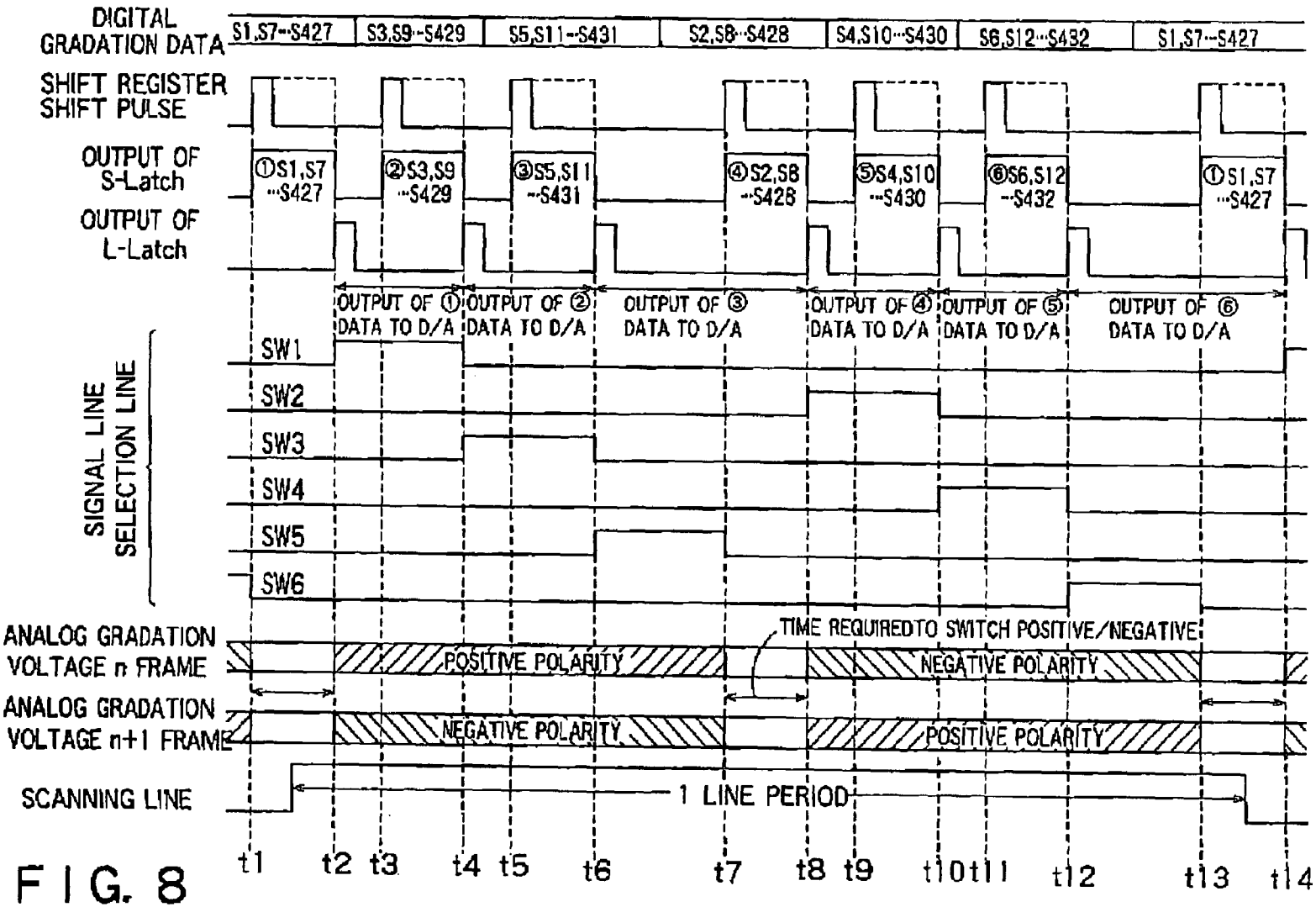
Figure 9:
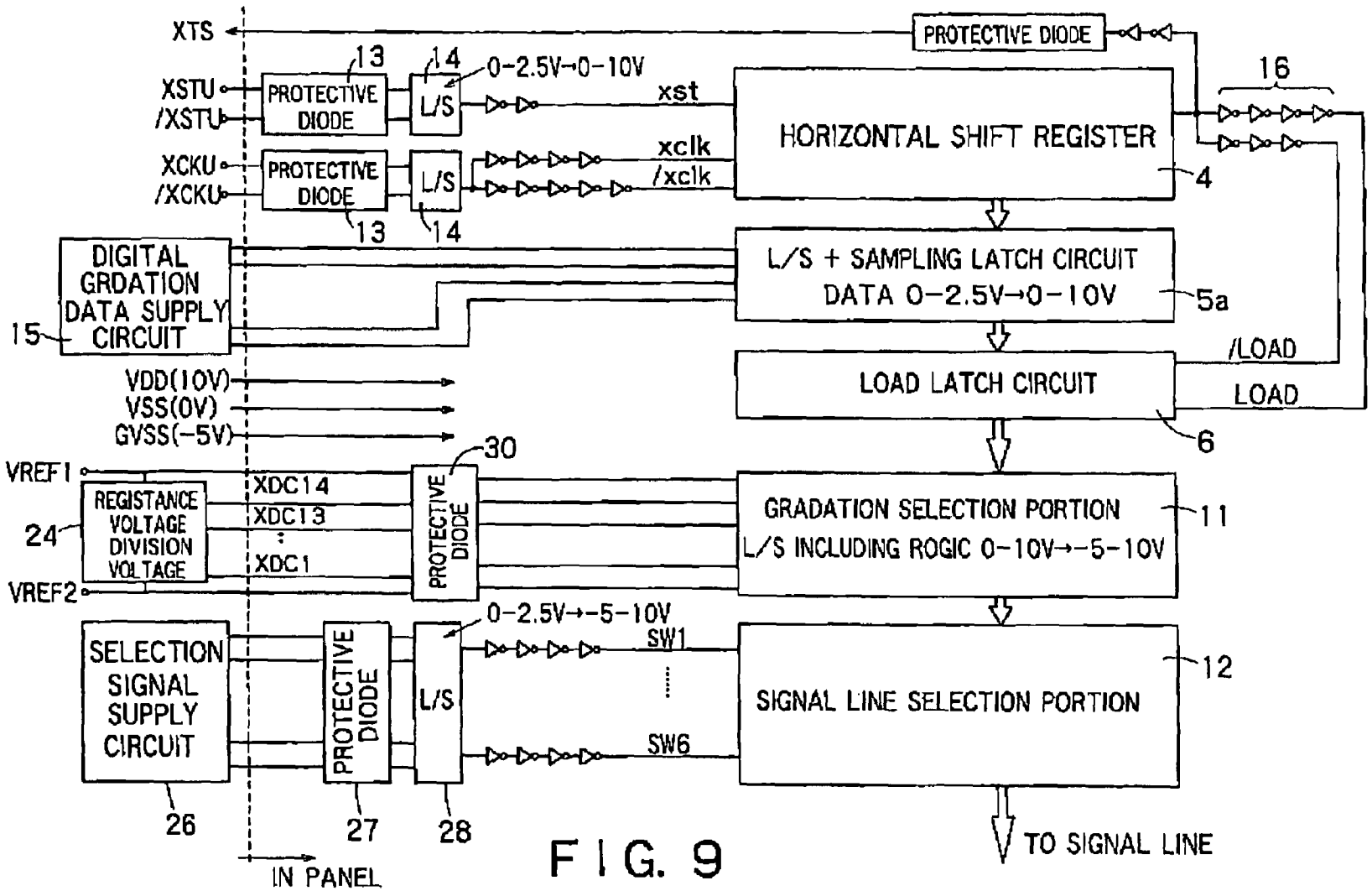
Figure 10:
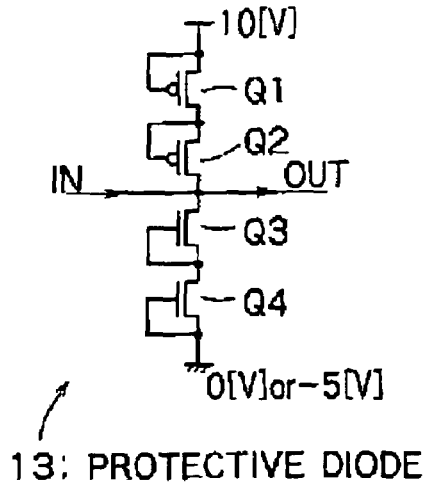
Figure 11:
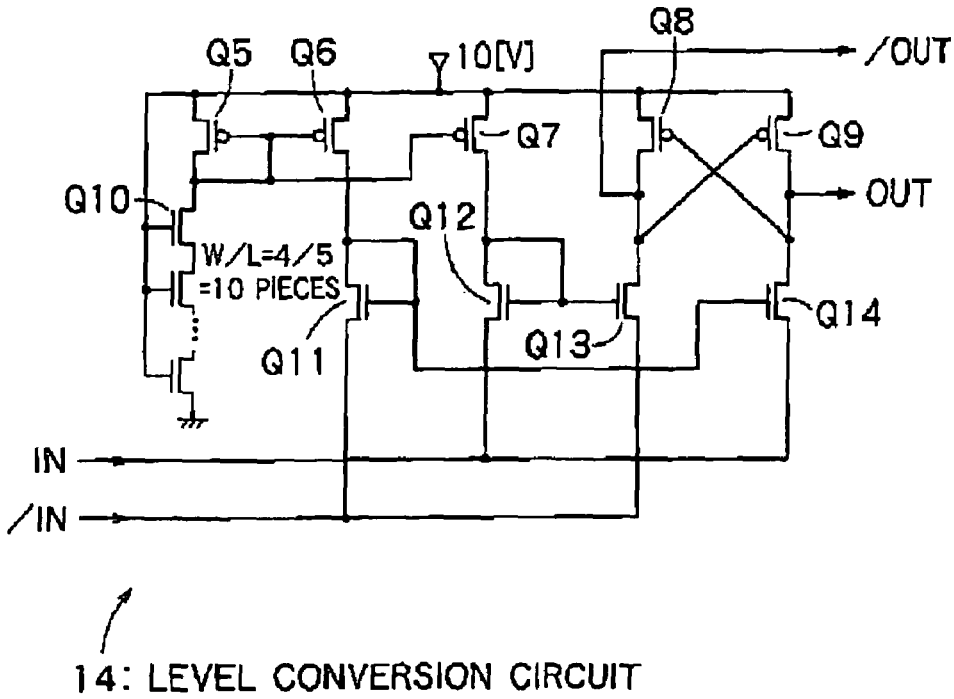
Figure 12:
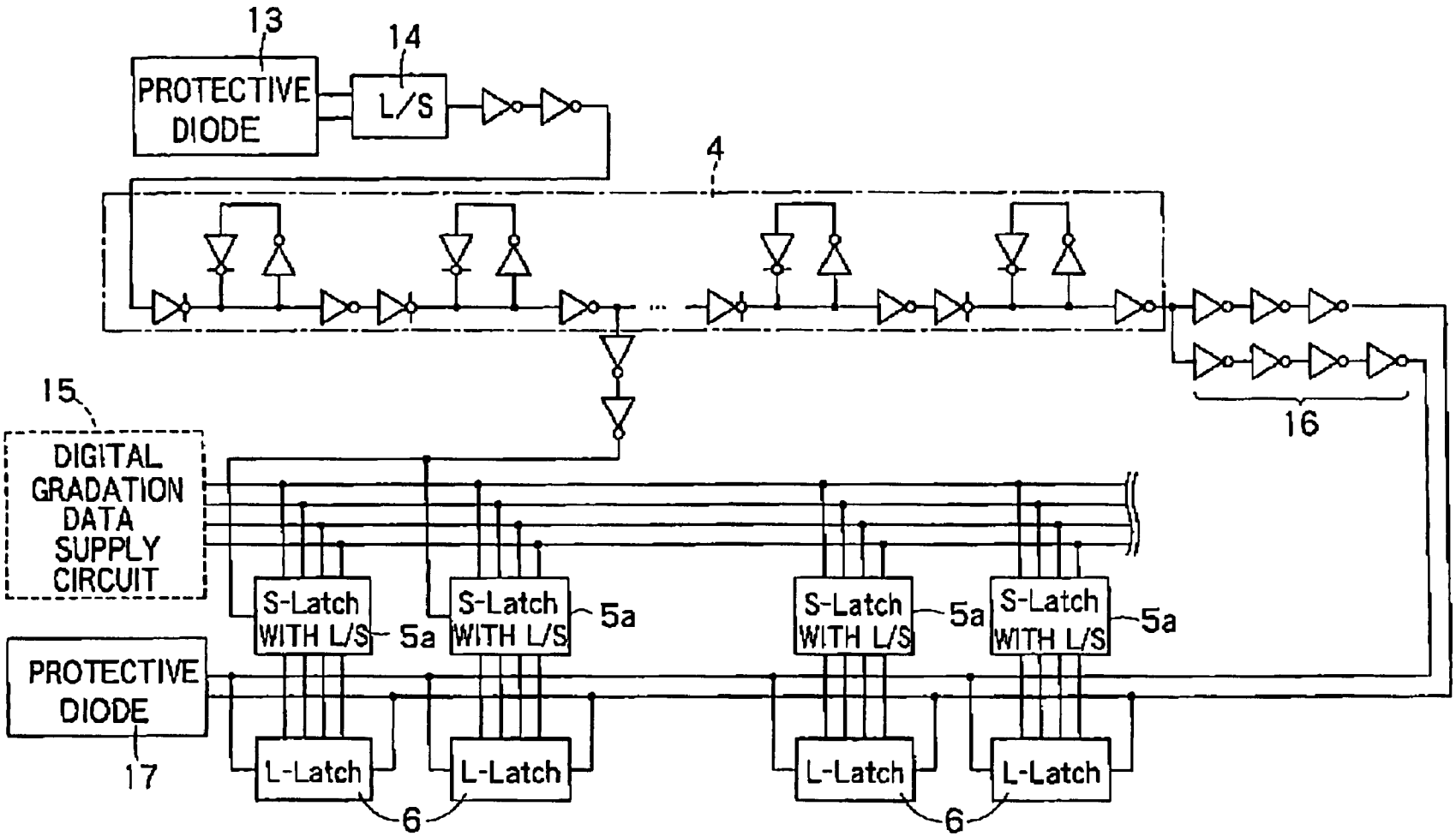
Figure 13:
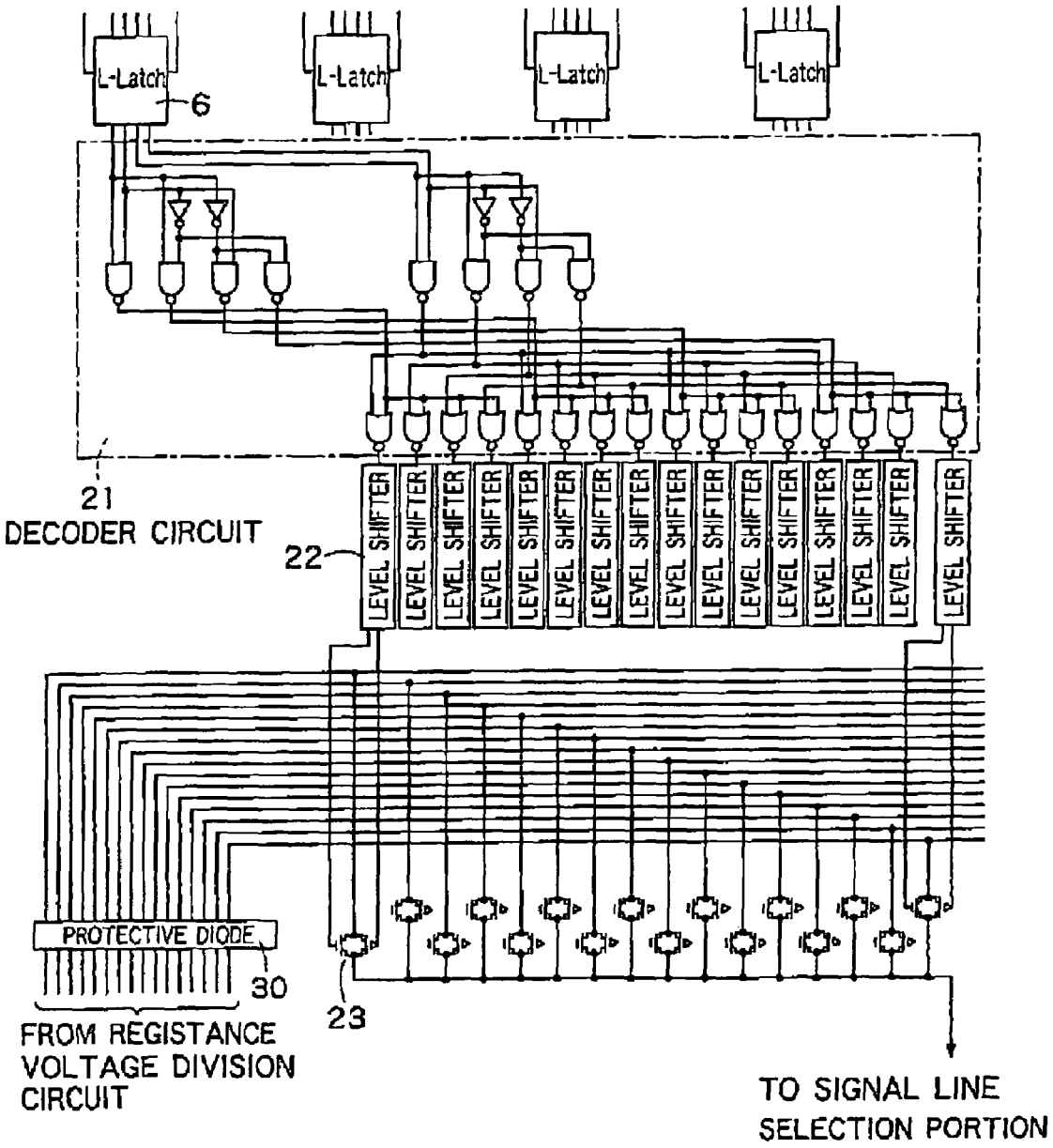
Figure 14:
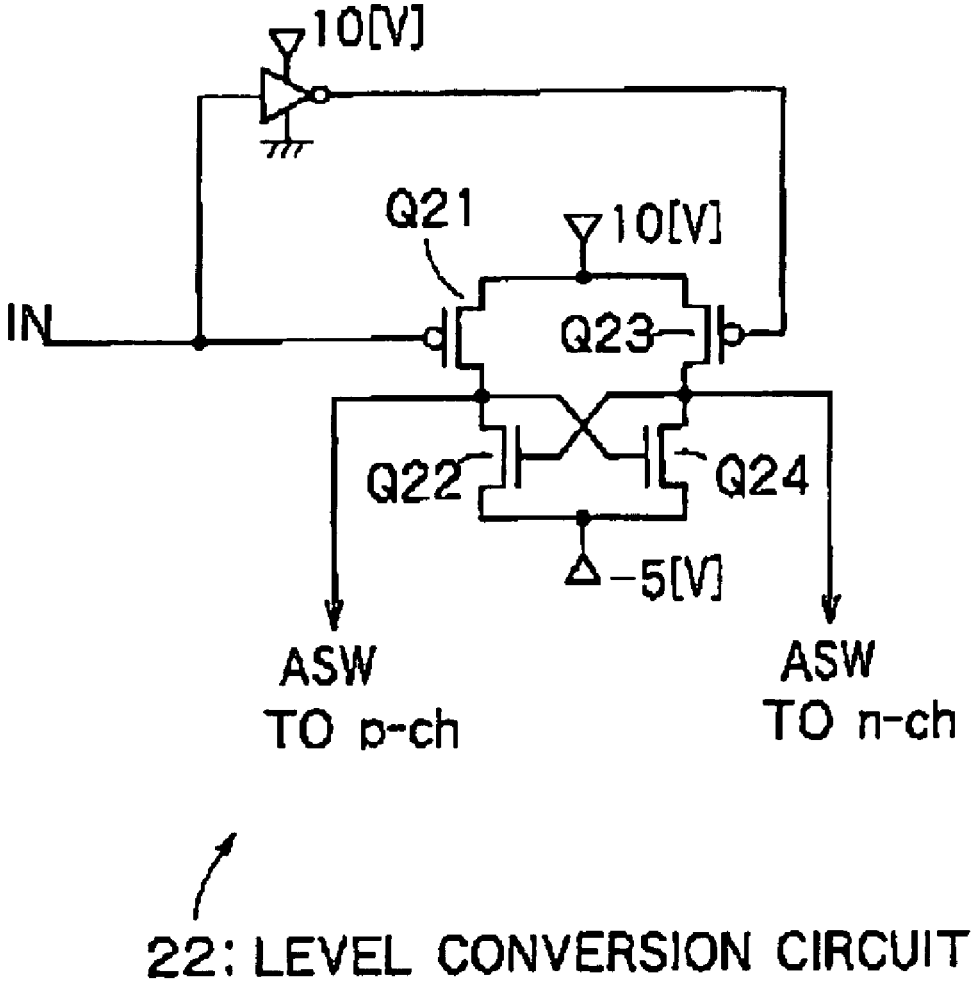
Figure 15:
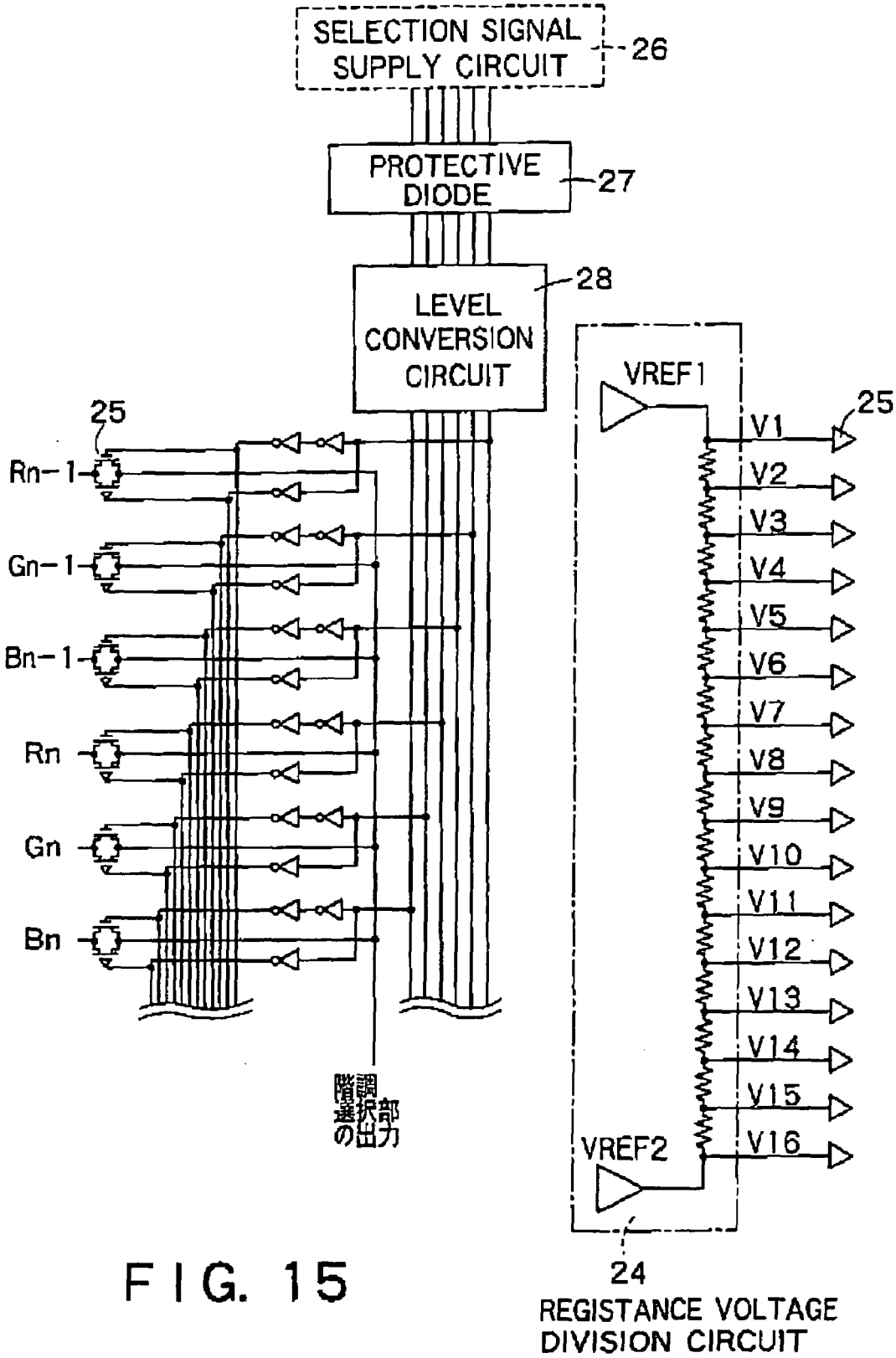
Figure 16:
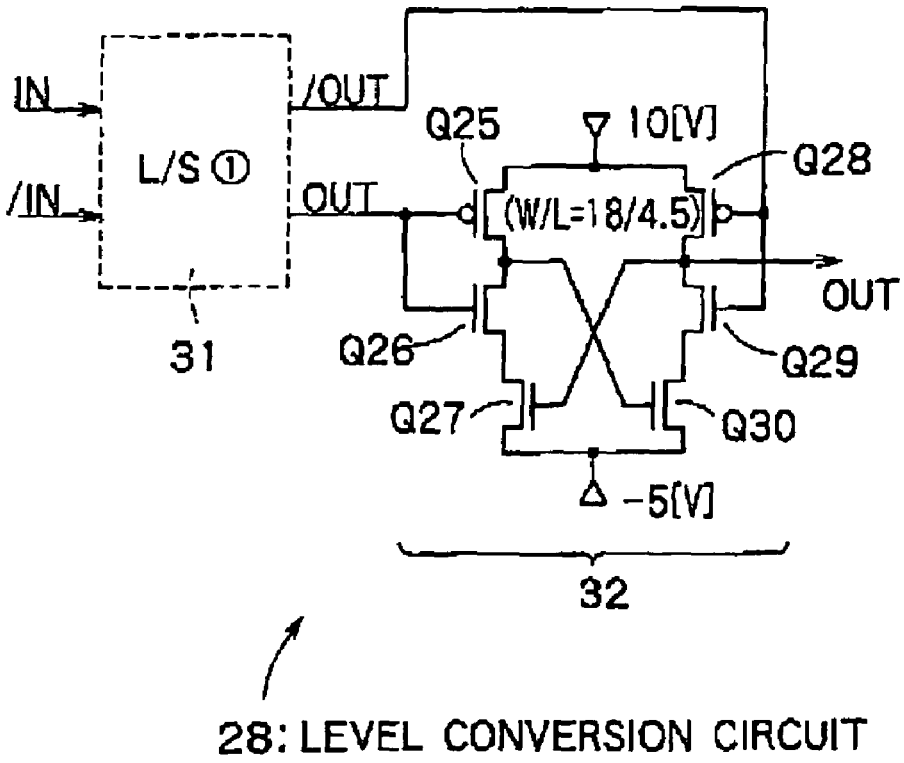
Figure 17:
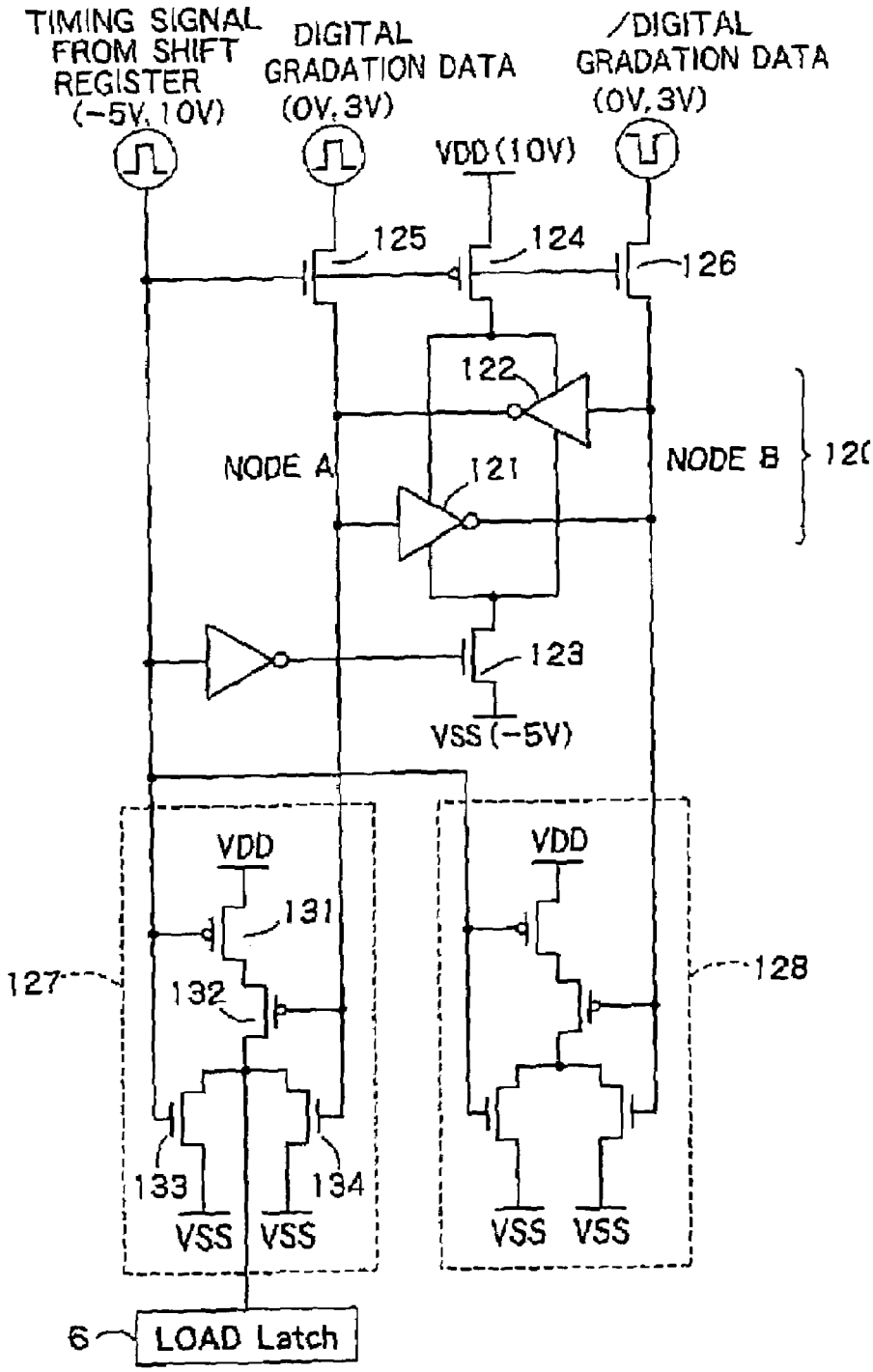
Figure 18:
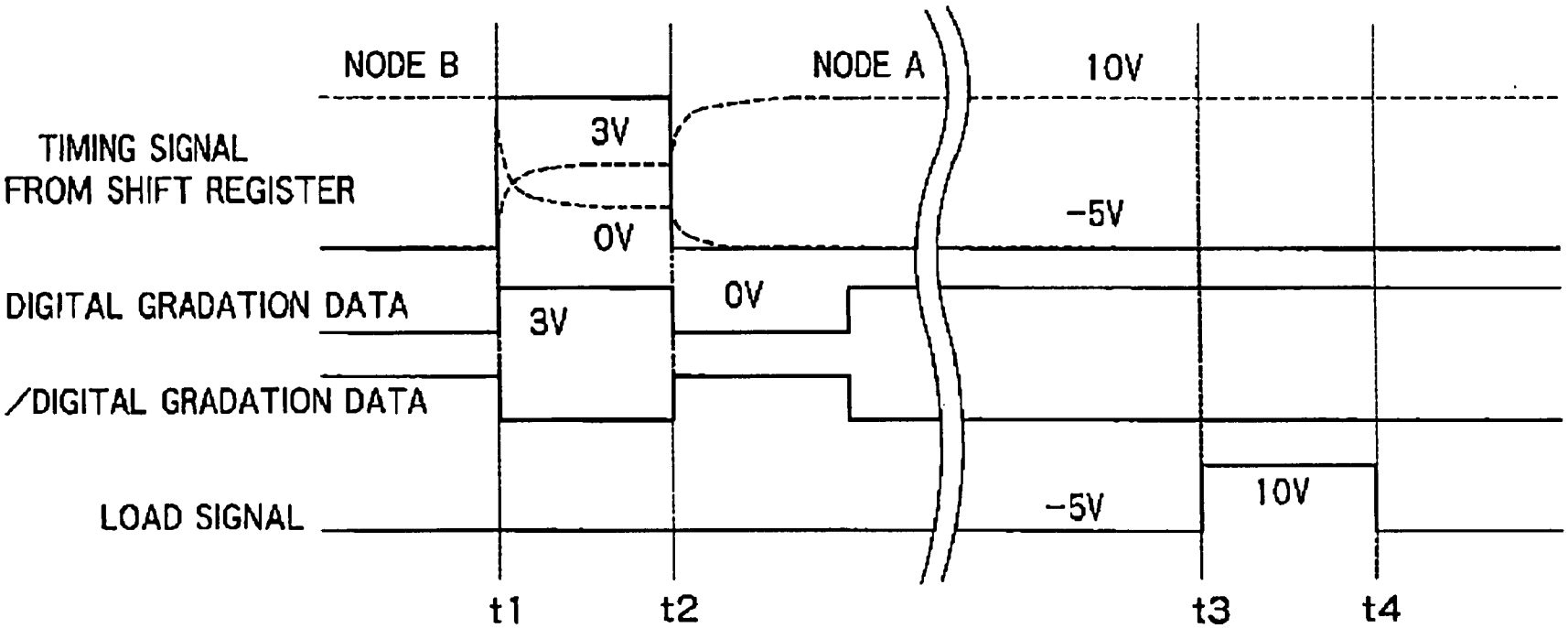
Figure 19:
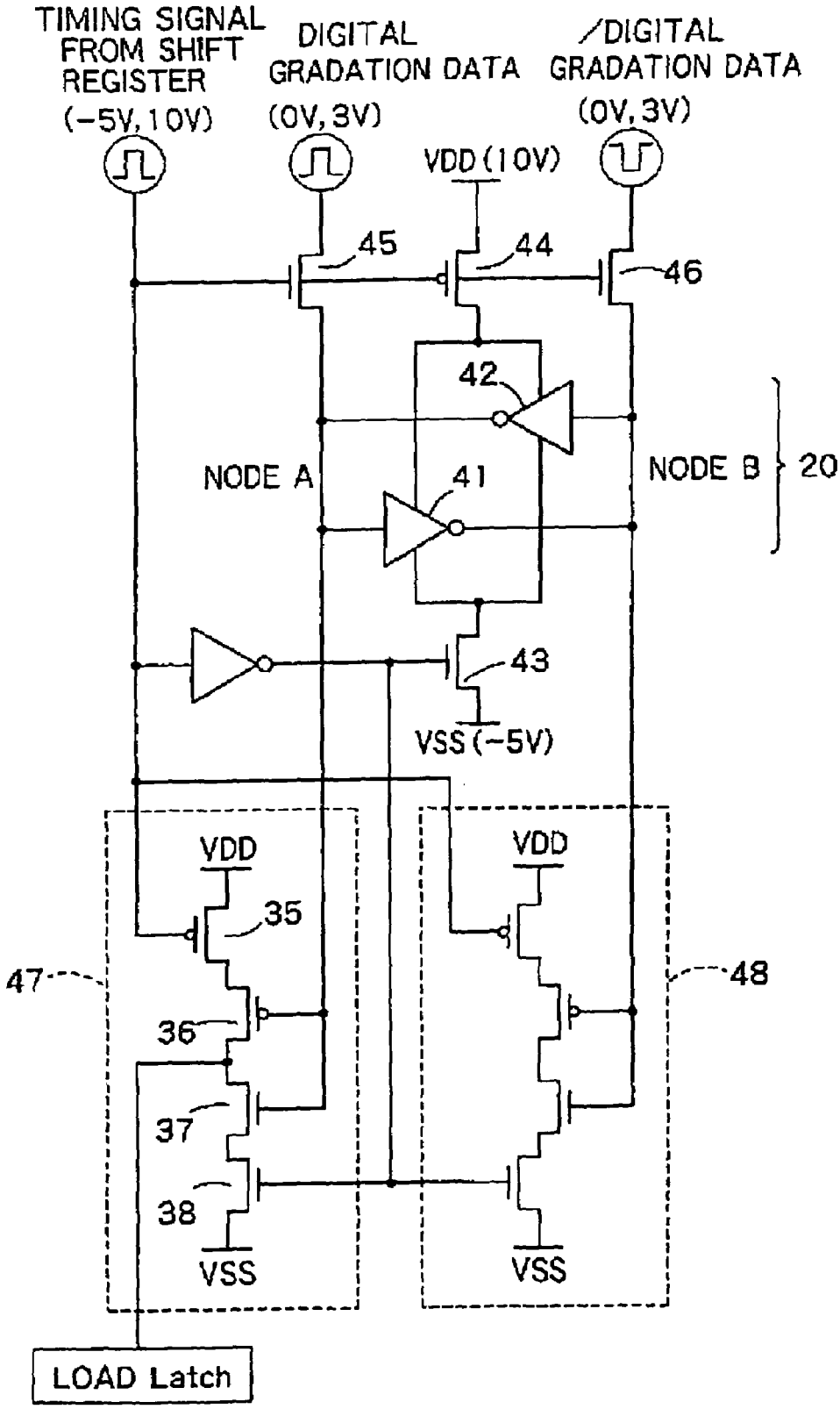
Figure 20:
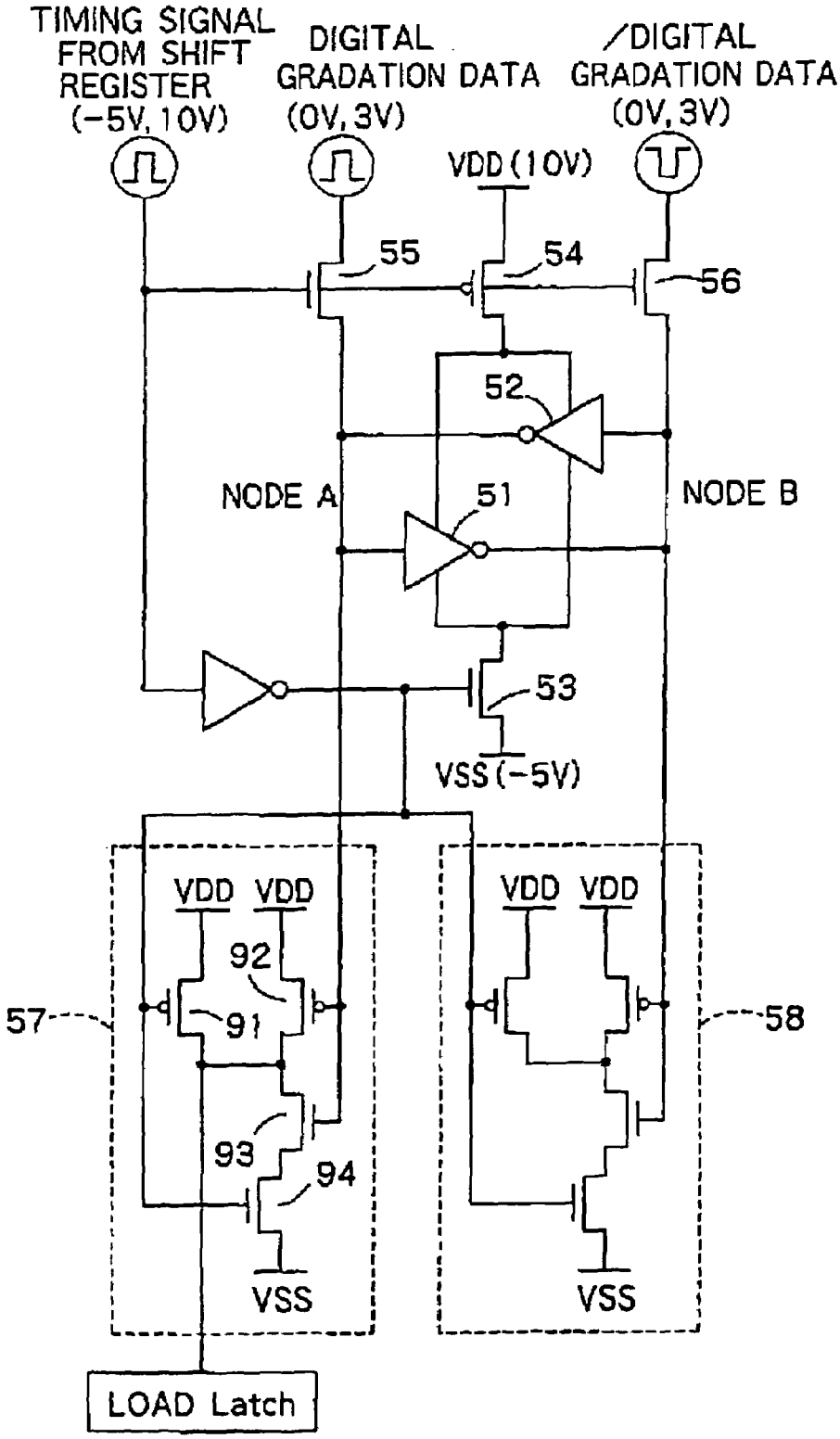
Figure 21:
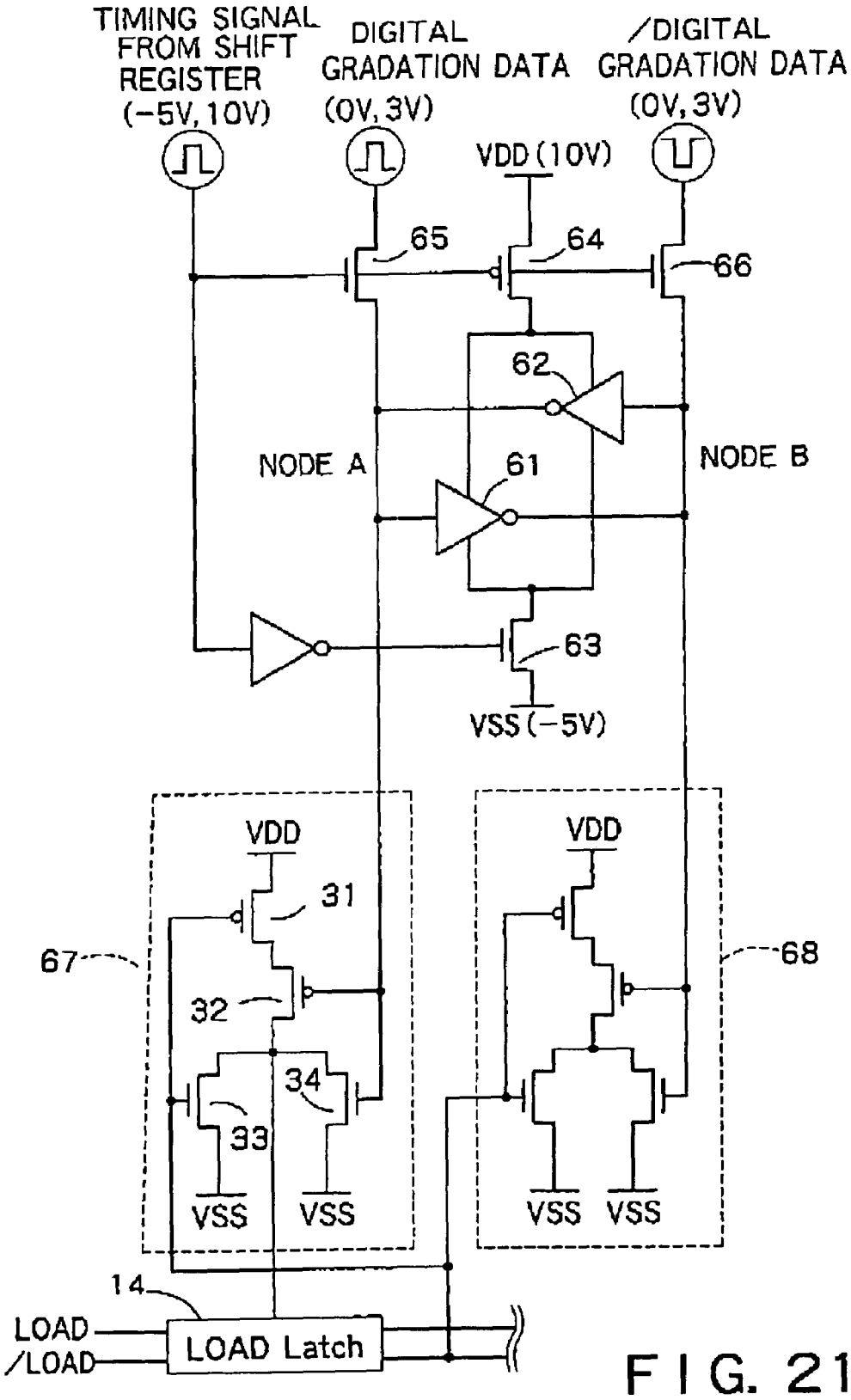

FIG, 4 is a circuit diagram of the sampling latch circuit in which only a signal on a node A side is supplied to a load latch circuit;

FIG. 5 is a block diagram showing a first embodiment of a liquid crystal display according to the present invention;

FIG. 6A is a view illustrating V-inversion driving, and FIG. 6B is a view illustrating HV-inversion driving;

FIG. 7 is a circuit diagram showing a detailed structure of a D/A conversion circuit 7 illustrated in FIG. 5;

FIG. 8 is a timing chart of the liquid crystal display depicted in FIG. 5;

FIG. 9 is a block diagram showing a second embodiment of a liquid crystal display according to the present invention;

FIG. 10 is a circuit diagram showing a detailed structure of a protective diode;

FIG. 11 is a circuit diagram showing a detailed structure of a level conversion circuit;

FIG. 12 is a circuit diagram showing the connection relationship between horizontal shift registers, sampling latch circuits and load latch circuits;

FIG. 13 is a circuit diagram showing detailed structure of a gradation selection portion;

FIG. 14 is a circuit diagram showing a detailed structure of the level conversion circuit;

FIG. 15 is a circuit diagram showing a detailed structure of a resistance voltage division circuit and a signal line section portion;

FIG. 16 is a circuit diagram showing a detailed structure of a level conversion circuit;

FIG. 17 is a circuit diagram showing a specific circuit structure of the sampling latch circuit 5;

FIG. 18 is an operation timing chart of the circuit illustrated in FIG. 17;

FIG. 19 is a circuit diagram showing the sampling latch circuit in which a clocked inverter is provided instead of an NOR circuit;

FIG. 20 is a circuit diagram of the sampling latch circuit in which an NAND circuit is provided instead of the NOR circuit; and FIG. 21 is a circuit diagram showing an example where transistors in the NOR circuit are turned on/off by a load signal.

DESCRIPTION OF THE PREFERRED EMBODIMENTS

A liquid crystal display according to the present invention will now be specifically described hereinafter with reference to the drawings. An example in which a drive circuit is integrally formed on an array substrate on which pixel TFTs are formed will be explained hereunder.

(First Embodiment)

FIG. 5 is a block diagram showing a first embodiment of a liquid crystal display according to the present invention. The liquid crystal display FIG. 5 is characterized in that a latch circuit and a D/A converter are provided for every signal lines and they are commonly used, thereby reducing the number of the latch circuits and the D/A converters in the signal line drive circuit.

In general, it is known that the orientation of the liquid crystal is fixed to dull up operation of the liquid crystal and the darkish display is obtained when a voltage is applied to a liquid crystal layer constantly in the same direction. Thus, there is proposed a liquid crystal display adopting an alternating drive system such as V-line inversion driving by which the polarity of a voltage applied to the liquid crystal layer is switched in accordance with each vertical line as shown in FIG. 6A or HV-inversion driving by which the polarity of the voltage is switched in units of one pixel as shown in FIG. 6B. Description will be given as to an example in which V-line inversion driving is carried out hereinafter.

The liquid crystal display shown in FIG. 5 includes a pixel array portion 1 having signal lines and scanning lines aligned therein, a signal line drive circuit 2 for driving each signal line, and a scanning line drive circuit 3 for driving each scanning line.

In this embodiment, an example where the pixel array portion 1 has the display resolution of 143×176 pixels will be explained. Since three signal lines of RGB are provided in accordance with each pixel, an aggregate number of signal lines is 144×3=432.

The signal lines and the scanning lines are aligned in the pixel array portion 1, and a TFT (Thin Film Transistor) 100 is formed in the vicinity of each intersection between the signal line and the scanning line. A gate terminal of the TFT 100 is connected to the scanning lines G1 to Gn, and a drain terminal of the TFT 100 is connected to the signal lines S1 to Sm. Further, a pixel electrode 101 is connected to a source terminal of the TFT 100.

The signal line drive circuit 2 includes a horizontal shift register 4, a plurality of sampling latch circuits (S-Latch, first latch circuit) 5 for latching digital gradation data from digital video bus lines L at timings different from each other; a plurality of load latch circuits (L-Latch, second latch circuit) 6 for latching data latched by each sampling latch circuit 5 at the same time; a plurality of D/A converters 7 for converting data latched by each load latch circuit 6 into an analog gradation voltage and a signal line selection circuit 8 for supplying the analog gradation voltage to a corresponding signal line.

In this embodiment, although an example of digital gradation data consisting of four bits will be described, the number of bits of the digital gradation data is not restricted.

The signal line selection circuit 8 has six pieces of analog switches ASW1 to ASW6 with respect to each D/A converter 7. These analog switches ASW1 to ASW6 are connected to signal lines different from each other, respectively. Only one of the respective analog switches ASW1 to ASW6 is turned on based on signal line selection signals SW1 to SW6. When the analog switches ASW1 to ASW6 are turned on, analog gradation voltages from the D/A converters 7 are supplied to corresponding signal lines.

FIG. 7 is a circuit diagram showing a detailed structure of the D/A converter 7 illustrated in FIG. 5. As shown in the drawing, the D/A converter 7 includes a plurality of four-input NAND gates G1 to G16, switches SW1 to SW16 controlled to be turned on/off by outputs of the respective NAND gates, and inverters IV1 to IV4 for buffering outputs of the load latch circuits 6. The switches SW1 to SW16 are turned on/off in accordance with the output logic of corresponding NAND gates. Voltages different from each other are applied to ends of the respective switches SW1 to SW16. When the switches are turned on, the analog gradation voltage at one end side is supplied to the signal line selection circuit 8 on the other end side.

The NAND gates G1 to G16 perform the logical operation based on the digital gradation data consisting of four bits and data obtained by inverting the digital gradation data by the inverters IV1 to IV4. As a result, only one of the NAND gates outputs the low level in accordance with the digital gradation data, and a corresponding switch is turned on.

FIG. 8 is a timing chart of the liquid crystal display depicted In FIG. 5, showing the digital gradation data on the digital video bus line L, a shift pulse outputted from the horizontal shift register 4, data latched by the sampling latch circuit 5, a latch pulse signal inputted to the load latch circuit 6, the signal line selection signals SW1 to SW6, the analog gradation voltage outputted from the D/A converter 7, and timing in the one-horizontal-line period .

The operation of the liquid crystal display illustrated in FIG. 5 will now be described with reference to the timing chart of FIG. 8 hereinafter. The horizontal shift register 4 starts the shift operation when a start pulse is inputted, and each output terminal of the horizontal shift register 4 sequentially outputs a shift pulse obtained by shifting the start pulse in order.

The sampling latch circuit 5 latches the digital gradation data on the digital video bus line L when the shift pulse is outputted from a corresponding output terminal of the horizontal shift register 4.

To the digital video bus line L is sequentially supplied the digital gradation data corresponding to every six signal lines. Specifically, the digital gradation data is supplied to the digital video bus line L in the order of (1) to (6) mentioned below.

(1) The digital gradation data corresponding to the signal lines S1. S7, S13, . . . , and S427 is first supplied to the video bus line L in order (time t1 in FIG. 8).

(2) The digital gradation data corresponding to the signal lines S3, S9, S15, . . ., and S429 is then supplied to the video bus line in order (time t3).

(3) The digital gradation data corresponding to the signal lines S5, S11, S17, . . . , and S431 is then supplied to the video bus line in order (time t5).

(4) The digital gradation data corresponding to the signal lines starting from S2, S8, S14, . . . , and S428 is then supplied to the video bus line in order (time t7).

(5) The digital gradation data corresponding to the signal lines starting from S4, S10, S16, . . ., and S430 is then supplied to the video bus line in order (time t9).

(6) The digital gradation data corresponding to the signal lines starting from S6, S12, S18, . . . , and S432 is then supplied to the video bus line in order (time t11).

When the processing from (1) to (6) are carried out, display for one horizontal line is completed, and a next line is displayed from and after the time t13. As described above, in the first embodiment, the signal lines are driven every six lines for six times.

The sampling latch circuit 5 effects the latch operation in accordance with a cycle, of the digital gradation data on the digital video bus line L. As a result, the sampling latch circuit 5 first latches the digital gradation data corresponding to the signal lines S1, S7, S13, . . . , and S427 (times t1 to t2), then latches the digital gradation data corresponding to the signal lines S3, S9, S15, . . . , S429 (times t3 to t4), and subsequently latches the digital gradation data corresponding to the signal lines S5, S11, S17, . . . , S431 (times t5 to t6). Further, the sampling latch circuit 5 latches the digital gradation data corresponding to the signal line S2, S8, 514, . . . , S428 (times t7 to t8), then latches the digital gradation data corresponding to the signal lines S4, S10, S16, . . . , S430 (times t9 to t10), and subsequent latches the digital gradation data corresponding to the signal lines S6, S12, S18, . . . , S432 (times t11 to t12).

When all the sampling latch circuits 5 have carried out latching for one time, the load latch circuits 6 simultaneously latch outputs from all the sampling latch circuit 5 (times t2, t4, t6, t8, t10 and t12). Therefore, each load latch circuit 6 performs the latch operation for six times while one horizontal line is displayed.

Furthermore, when the load latch circuit 6 is latching the data, the sampling latch circuit 5 latches the next digital gradation data (digital gradation data corresponding to an adjacent signal line).

The digital gradation data latched by the load latch circuit 6 is converted into a analog gradation voltage by the D/A converter 7. To the D/A converter 7 are supplied voltages having polarities reversed from each other in the first half and the last half of the one-horizontal-line period. For example, FIG. 8 shows an example where the voltage with a positive polarity is supplied in the first half of the one-horizontal-line period in an n-th frame and a voltage with a negative polarity is supplied in the last half. In this case, a voltage with the negative polarity is supplied in the first half of the one-horizontal-line period and a voltage with the positive polarity is supplied in the last half in the next frame.

The analog gradation voltage outputted from the D/A converter 7 is supplied to a signal line selected by the signal line selection circuit 8. The signal line selection circuit 8 selects a signal in accordance with the logic of the signal line selection signals SW1 to SW6.

The signal line selection signals SW1 to SW6 rise to the high level in the order of SW1, SW3, SW5, SW2, SW4 and SW6. Therefore, the signal lines are selected in the order of S1, S7, . . . , S427, S3, S9, . . . , S429, S5, S11, . . . , S431, S2, S8, . . . , S428, S4, S10, . . . , S430, S6, S12, . . . , and S432.

In this manner, the signal line drive circuit 2 of this embodiment drives the odd-numbered signal lines in the first half of a one-horizontal-line period and drives the even-numbered signal lines in the last half of the same. As described above, since the polarities of the analog gradation voltage outputted from the D/A converter 7 are reversed from each other in the first half and the last half of a one-horizontal-line period, voltages having opposite polarities are supplied to the adjacent signal lines, and such V-inversion driving as shown in FIG. 6A is carried out.

In case of the V-inversion driving, as shown in FIG. 6A, since it is general to switch the voltage polarity of each signal line in accordance with each frame, the voltage polarity of each signal line can be switched by reversing the polarity of voltage supplied to the D/A converter 7 in accordance with each frame. A number of frames per one second is set to, for example, 60 in accordances with a usual CRT.

Since the signal lines are driven every six lines in this embodiment as described above, setting a numbers of the sampling latch circuits 5, the load latch circuits 6 and the D/A converters 7 to ⅙ of an aggregate number of the signal lines can suffice, and a mounting area of the signal line drive circuit 2 can be further reduced as compared with the prior art. Thus, the pixel array portion 1 and the signal line drive circuit 2 can be easily formed on the same substrate.

Further, after driving the odd-numbered signal lines in the first half of a one-horizontal-line period, the even-numbered signal lines are driven in the last half of the same. Therefore, V-inversion driving can be readily realized by only switching the polarity of the analog gradation voltage in the first half and the last half of a one-horizontal-line period. That is, since the number of times for switching the voltage polarity can be reduced, the voltage control can be facilitated, thereby being hardly influenced by noises.

Figure 1:
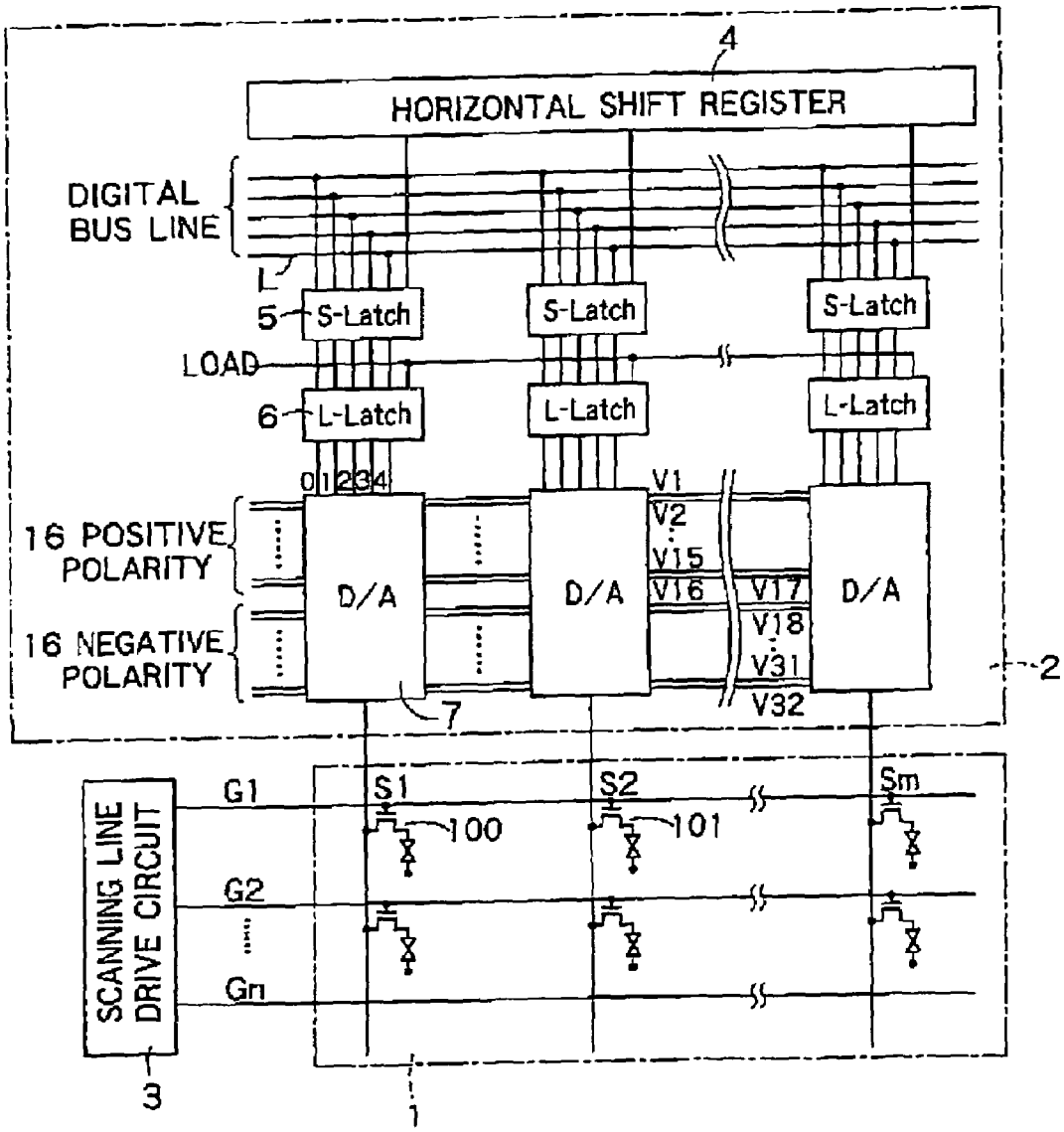
FIG. 1 is a block diagram showing a schematic structure of a conventional liquid crystal display.

Furthermore, as shown in FIG. 1, although the prior art needs the gradation power supply wirings for the positive polarity and the gradation power supply wirings for the negative polarity (32 in all), the number of these wirings can be reduced to half in this embodiment, thereby decreasing the wiring area.

Moreover, assuming that the number of bits of the digital gradation data is n, the prior art requires (n+1) digital video bus lines L including the polarity discrimination signal, but the present embodiment can reduce this number to n.

In addition, although all of the sampling latch circuit 5, the load latch circuit 6, and the D/A converter 7 must process the digital data consisting of (n+1) bits including the polarity discriminate signal, each circuit can process the digital data consisting of only n bits in this embodiment. Therefore, the mounting area of each of the sampling latch circuit 5, the load latch circuit 6 and the D/A converter 7 can be reduced one bit.

(Second Embodiment)

A second embodiment is a concrete example of the first embodiment, and shows an example in which a liquid crystal display having the display resolution of the 16-gradation QCIF standard (144×176 pixels) is constituted.

FIG. 9 is a block diagram of the second embodiment of the liquid crystal display according to the present invention and shows a structure of a signal line drive circuit 2. The signal line drive circuit 2 in the second embodiment includes a horizontal shift register 4, a sampling latch circuit 5*a* having a level conversion circuit, a load latch circuit 6, a gradation selection portion 11, and a signal line selection portion 12.

A protective diode 13 and a level conversion circuit (L/S, first level conversion circuit) 14 are connected between the horizontal shift register 4 and external input terminals XSTU,/XSTU, XCKU, and /XCKU. This level conversion circuit 14 converts the level of each signal inputted to the external input terminals XSTU, XCKU to generate a start pulse signal xst and a dot clock signal xclk and supplies these signals to the horizontal shift register 4.

For example, as shown in FIG. 10, the protective diode 13 is constituted by PMOS transistors Q1 and Q2 and NMOS transistors Q3 and Q4 connected between the power supply terminal and the ground terminal in series. It is to be noted that the protective diode 13 is not necessarily an essential constituent part.

The level conversion circuit 14 is constituted by a circuit such as shown in FIG. 11. The illustrative level conversion circuit converts input signals IN and /IN having a voltage amplitude of 0 to 2.5V into output signals OUT and /OUT having a voltage amplitude of 0 to 10 V.

The level conversion circuit 14 shown in FIG. 11 is configured by PMOS transistors Q5 to Q9 and NMOS transistors Q10 to Q14. The NMOS transistors Q11 and Q14 constitute a differential amplifier and the NMOS transistors Q12 and Q13 constitute another differential amplifier. These differential amplifiers output a voltage according to the logic of the input signals IN and /IN. Specifically, a signal having a voltage amplitude of 0 to 10 V is outputted from the drain terminal of the NMOS transistors Q13 and Q14.

The horizontal shift register 4 is constituted by combining a clocked inverter and an inverter as illustrated in a detailed circuit diagram of FIG. 12.

Digital gradation data consisting of four bits is externally supplied to the sampling latch circuit 5*a*. The sampling latch circuit 5*a* includes therein a plurality of latch circuits (each block 5*a* in FIG. 12), and each latch circuit latches the digital gradation data based on a shift pulse outputted from the horizontal shift register 4. The digital gradation data is generated by the digital gradation data supply circuit 15 provided outside a panel.

The load latch circuit 6 latches latch outputs from all the latch circuits in the sampling latch circuit 5*a* at the same time bated on load signals LOAD and /LOAD.

The load signals LOAD and /LOAD are generated based on a register output from a last stage of the horizontal shift register 4. Specifically, the load signals LOAD and /LOAD are obtained by splitting the register output from the last stage of the horizontal shift register 4 into a plurality of parts by an inverter chain circuit 16. The reason for splitting the register output into multiple parts is reduction of fan-out of the load signals LOAD and /LOAD. The protective diode 17 is connected to an output terminal of the inverter in circuit 16.

As described above, by generating the load signals LOAD and /LOAD by using the output from the horizontal shift register 4, the load signal does not have to be externally supplied, thereby decreasing the number of input signals.

A gradation selection portion 11 includes a decoder circuit 21, a plurality of level conversion circuits (lever shifters, second level conversion circuits) 22 connected to each output terminal of the decoder circuit 21, and a plurality of analog switches (selection circuits) 23 controlled to be turned on/off in accordance with an output from each level conversion circuit 22, as illustrated in a detailed circuit diagram of FIG. 13.

A plurality of circuits depicted in FIG. 13 are provide to the gradation selection portion 11. Specifically, the circuit of FIG. 13 is provided in accordance with each latch circuit in the load latch circuit 6.

The level conversion circuit 22 is constituted by, for example, a circuit shown in FIG. 14. The circuit depicted in FIG. 14 includes a PMOS transistor Q21 and an NMOS transistor Q22 connected between 10 V and (−5) V in series and a PMOS transistor Q23 and an NMOS transistor Q24 similarly connected between 10 V and (−5) V in series. The input voltage of 0 to 10 V is converted into a voltage of (−5) to 10 V by the level conversion circuit 22.

The analog gradation voltage is supplied to one end of an analog switch 23. The analog gradation voltage is generated by a resistance voltage division circuit 24 shown in FIG. 15. The analog gradation voltages V1 to V16 outputted from the resistance voltage division circuit 24 are supplied to one end of each corresponding analog switch through an analog buffer (electric current amplification circuit) 25 and the protective diode 30. A corresponding signal line is connected to the other end of the analog switch 23.

Two types of reference voltages Vref1 and Vref2 are supplied from outside to the resistance voltage division circuit 24. The analog gradation voltage is generated by dividing these reference voltages depending on the resistance.

As described above, by providing the analog buffer 25 between the resistance voltage division circuit 24 and the analog switch 23, a large amount of electric current does not have to flow from the resistance voltage division circuit 24 toward the analog switch 23 side, thereby reducing the electric current consumption in the resistance voltage division circuit 24. Specifically, the resistance value of the resistance device in the resistance voltage division circuit 24 can be sufficiently increased.

Among 16 pieces of analog switches 23 shown in FIG. 13, only one analog switch is turned on and the analog gradation voltage according to the digital gradation data is selected.

The signal line selection portion 12 has a plurality of analog switches 25 as illustrated in a detailed circuit diagram of FIG. 15. Specifically, six pieces of analog switches 25 are provided in accordance with 16 pieces of analog switches 23 in the gradation selection portion 11. The one end of each of the six pieces of analog switches 25 is connected to one end of each of 16 analog switches 23 in the gradation selection portion 11. In addition, the other end of each of the six pieces of analog switches 25 is connected to a corresponding signal line. The six pieces of analog switches 25 are controlled to be turned on/off in accordance with the logic of signal line selection signals SW1 to SW6.

The signal line selection signals SW1 to SW6 supplied from a selection signal supply circuit 26 provided outside the panel are subjected to voltage level conversion by the level conversion circuit 28 through the protective diode 27 and then supplied to the control terminals of the analog switches 25.

The level conversion circuit 28 is constituted by, for example, a circuit shown in FIG. 16. In this circuit, the signal line selection signal having a voltage amplitude of 0 to 2.5 V is converted into a signal having a voltage amplitude of (−5) to 10 V. The level conversion portion 31 indicated by a dotted line show in FIG. 16 is the same as the circuit depicted in FIG. 11 and has a structure in which a level conversion portion 32 consisting of PMOS transistors Q25 and Q28 and NMOS transistors Q26, Q27, Q29 and Q30 is added to the rear stage of this circuit. In the level conversion portion 32, the signal having a voltage amplitude of 0 to 10 V which is an output from the level conversion portion 31 is converted into a signal having a voltage amplitude of (−5) to 10 V.

The signal line selection portion 12 selects only one of the six adjacent signal lines in accordance with the logic of the signal line selection signals SW1 to SW6.

The circuit show in FIG. 15 is provided for every six signal lines, and each circuit supplies the analog gradation voltage to only one signal line. As a result, display is effected every six signal lines. As shown in FIG. 15, since the signal lines corresponding to respective colors of RGB are alternately aligned in the pixel array portion 1, display is carried out in units of two pixels.

As described above, in the second embodiment, since every six signal lines are driven for six times when displaying one horizontal line, the sampling latch circuit 5*a*, the load latch circuit 6 and the gradation selection portion 11 can be commonly used, and the structure of the signal line drive circuit 2 can be simplified.

Additionally, since the level conversion circuits 14, 22 and 28 for converting the voltage level of various kinds of signals inputted from outside are provided, a digital type signal having a small amplitude can be directly inputted, and it is unnecessary to perform level conversion in outside of the substrate. Further, the voltage amplitude of a signal inputted to the control terminal of the analog switch 23 can be increased by the exclusive level conversion circuit 22, and the analog switch 23 can be hence rapidly turned on/off.

Furthermore, since the resistance voltage division circuit 24 generates 16 types of analog gradation voltages based on only two types of voltages supplied from outside, a plurality of types of voltage do not have to be externally inputted. Moreover, since the analog buffer 25 is connected to each output terminal of the resistance voltage division circuit 24, it is not necessary to flow a large amount of electric current from the resistance voltage division circuit 24 to the analog switch 23, thereby reducing the electric current consumption in the resistance voltage division circuit 24.

(Third Embodiment)

A third embodiment is characterized in that a passing electric current does not flow from a power supply voltage terminal VDD to a ground terminal VSS in a sampling latch circuit 5.

FIG. 17 is a circuit diagram of a third embodiment of the sampling latch circuit 5. The sampling latch circuit 5 depicted in FIG. 17 includes a memory circuit 120 consisting of two inverters (first and second inverters) 121 and 122 each having an output terminal and an input terminal connected in the loop form, transistors (first and second switch devices) 123 and 124 for switching and controlling whether the power supply voltage VDD and the ground voltage VSS are to be supplied to each of these inverters, transistors (third switch devices) 125 and 126 for switching and controlling whether digital gradation data is to be supplied to the memory circuit 120, and NOR circuits (output circuits, first and second logic operation circuits) 127 and 128 for supplying data stored in the memory circuit 120 to a load latch circuit 6 in a non-sampling period.

A timing signal (shift pulse) from a non-illustrated horizontal shift register 4 is inputted to a gate terminal of each of PMOS transistors 124 to 126. The timing signal on the high level means a sampling period. A signal obtained by inverting this timing signal by an inverter 129 is inputted to a gate terminal of the NMOS transistor 123.

The NOR circuits 127 and 128 include PMOS transistors 131 and 132 and NMOS transistors 133 and 134. When the timing signal from the horizontal shift register 4 is on the high level, i.e., in the sampling period, the transistor 133 is turned on while the transistor 131 is turned off, and outputs from the NOR circuits 127 and 128 are fixed to the low level. Further, when the timing signal from the horizontal shift register 4 is on the low level, i.e., in a non-sampling period, the transistor 131 is turned on while the transistor 133 is turned off, and data obtained by inverting the digital gradation data is outputted from the NOR circuits 127 and 128.

The circuit operation of the data latch circuit depicted in FIG. 17 will now be described based on a timing chart of FIG. 18.

At a time t1, when the timing signal from the horizontal shift register 4 rises to the high level, the NMOS transistor 123 and the PMOS transistor 124 are turned off, the NM0S transistor 125 and the NMOS transistor 126 are turned on, and the digital gradation data and its inverted data are respectively fetched to a node A and a node B.

Subsequently, at a time t2, when the timing signal from the horizontal shift register 4 falls to the low level, the NMOS transistor 123 and the PMOS transistor 124 are turned on in place of the NMOS transistor 125 and the NMOS transistor 126 being turned off. Although the digital gradation data is not fetched to the sampling latch circuit 5, the power supply voltages VDD and VSS are supplied to the memory circuit 120. The memory circuit 120 compares the voltages of the digital gradation data with that of the /digital gradation data in the nodes A and B and performs level conversion so that the high level voltage VHigh becomes VDD and the low level voltage VLow becomes VSS. That is, the memory circuit 120 converts the level of the data fetched into the nodes A and B and holds the resulting data immediately before the time t2.

Data having an amplitude of 0 to 3 V is supplied to the NOR circuits 127 and 128 in a period from the time t1 to the time t2. In this period, since the timing signal from the shift register 11 is on the high level , the PMOS transistor 131 in the NOR circuits 127 ad 128 is in the off state, Therefore, the passing electric current does not flow from the power supply terminal VDD to the ground terminal VSS, and the power consumption can be greatly reduced as compared with the prior art sampling latch circuit 5.

Further, since the sampling latch circuit 5 depicted in FIG. 17 has the NOR circuits 127 and 128 on each of the node A side and the node B side, the parasitic capacitance of the node A is substantially equal to that of the node B, and the digital date can be stably boosted at the time t2 as similar to the prior art sampling latch circuit 5.

Figure 2:
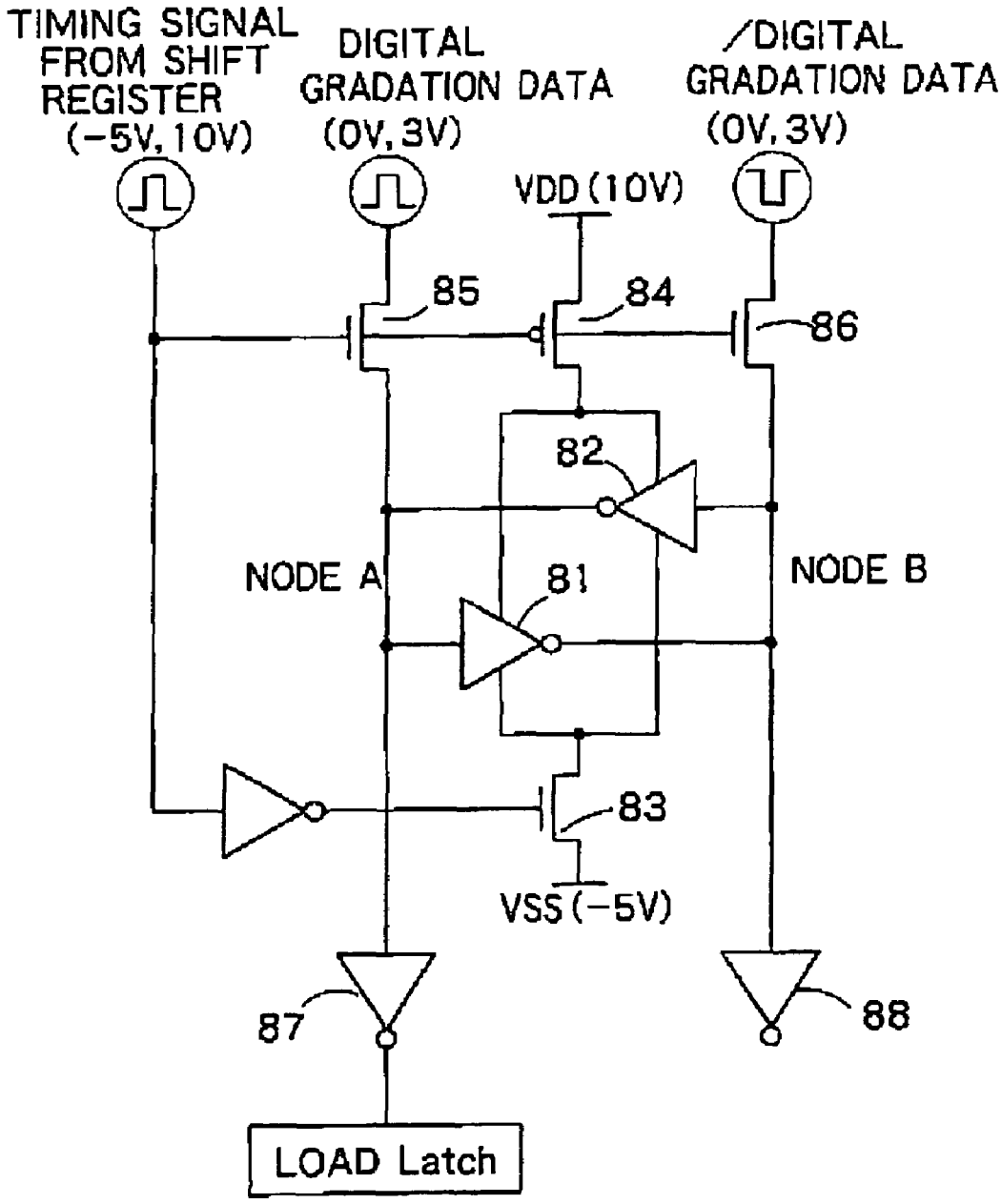
FIG. 2 is a view showing a specific circuit structure of sampling latch circuit.

After the time t2, the timing signal from the horizontal shift register 4 falls to the low level, and the NOR circuits 127 and 128 function as simple inverter circuits. Thus, the output similar to that of the prior art sampling latch circuit 5 shown in FIG. 2 can be supplied to the load latch circuit 6.

As described above, in this embodiment, since the output from the sampling latch circuit 5 is set to the fixed logic in the sampling period, the passing electric current does not flow from the power supply voltage terminal VDD to the ground terminal VSS in the sampling period, thereby reducing the power consumption.

Although the example in which the NOR circuits 127 and 128 are inserted to the output stage of the sampling latch circuit 5 has been described with reference to FIG. 17, the similar effect can be obtained by inserting any other circuit device having a function for preventing the passing electric current from flowing from the VDD to the VSS in the ON period of the horizontal shift register 4 instead of the NOR circuits 127 and 128. For example, insertion of the clocked inverters 47 and 48 as shown in FIG. 19 can so obtain the similar effect.

The clocked inverters 47 and 48 shown in FIG. 19 have four transistors 35 to 38 connected between the power supply voltage VDD) and the ground voltage VSS in series. The transistor 35 and 38 are turned on when the timing signal from the horizontal shift register 4 is on the low level, i.e., in the non-sampling period. When these transistors 35 and 38 are turned on, the digital gradation data is inverted and outputted from the clocked inverters 47 and 48. On the other hands in the sampling period, the transistors 35 and 38 are turned off, and the clocked inverters 47 and 48 maintain the immediately preceding state.

As described above, the transistors 35 and 38 in the clocked inverters 47 and 48 can prevent the passing electric current from flowing through the clocked inverters 47 and 48.

As a modification other than the clocked inverters 47 and 48, NAND circuits 57 and 58 may be inserted as shown in FIG. 20. Each of the NAND circuits 57 and 58 shown in FIG. 20 is constituted by transistors 91 to 94. The transistor 91 is turned on when the timing signal from the horizontal shift register 4 is on the high level, i.e., in the sampling period. At this time, the output from the sampling latch circuit 5 is fixed to the high level, and the passing electric current does not flow through the NAND circuits 57 and 58. On the other hand, when the timing signal from the horizontal shift register 4 is on the low level, i.e., in the non-sampling period, the transistor 91 is turned off while the transistor 94 is turned on, and data obtained by inverting the digital gradation data is outputted from the sampling latch circuit 5.

Moreover, in the above-described embodiment, although the timing signal from the shift register 11 or its inversion signal is utilized as a signal for preventing the passing electric current, additionally providing a signal having a function for preventing the passing electric current from flowing in a period from the time t1 to the time t2 can similarly prevent the passing electric current.

Figure 3:
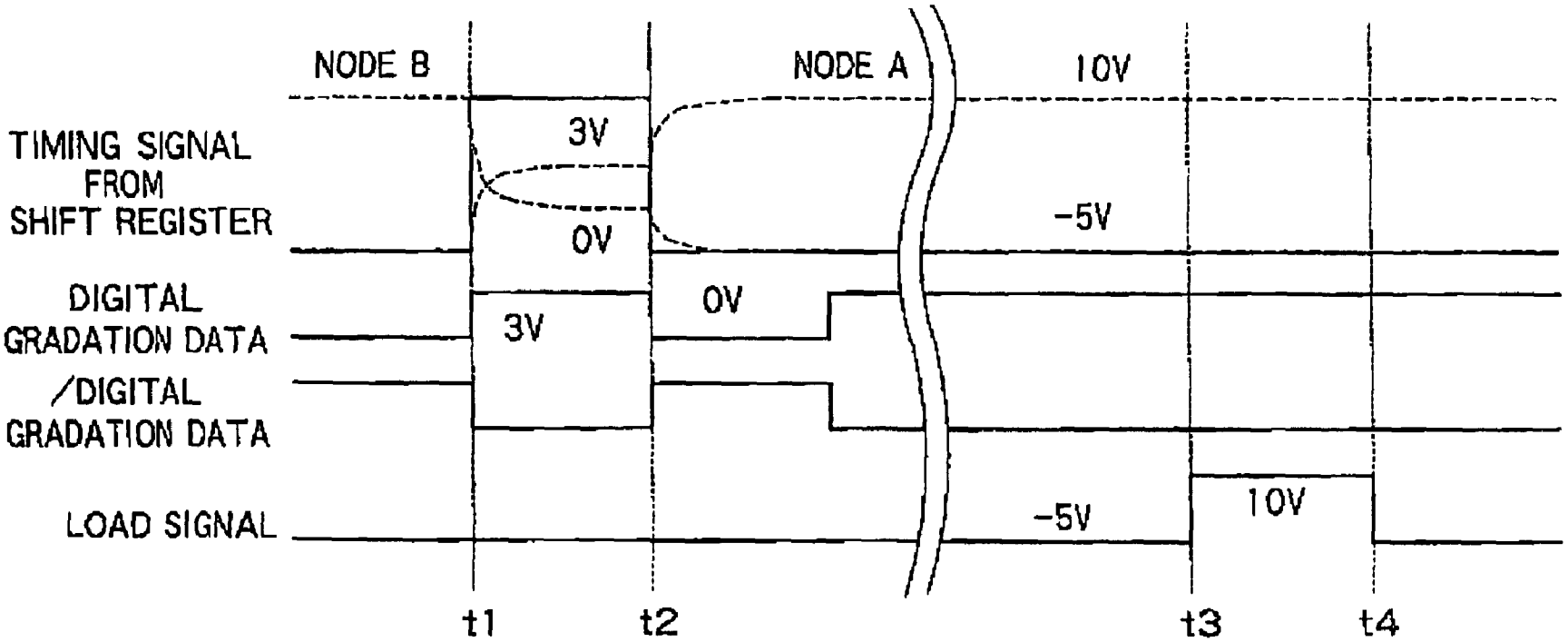
FIG. 3 is an operation timing chart of the circuit illustrated in FIG. 2.
Figure 4:
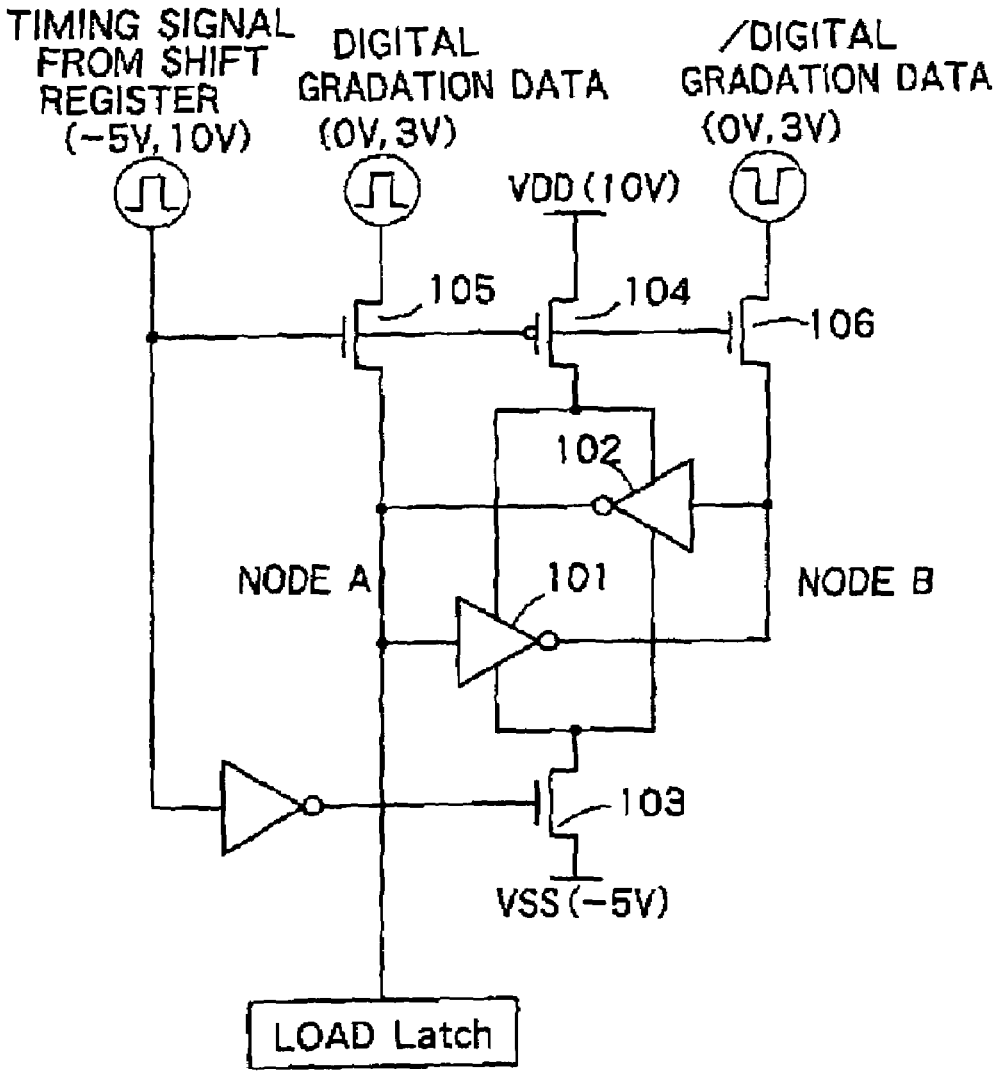

For example, FIG. 21 is a circuit diagram showing an example in which transistors in the NOR circuits 67 and 68 are turned on/off by using a load signal. Since the load signal rises to the high level in a period from a time t3 to a time t4 as shown in FIG. 3, the transistor 133 is turned on and the transistor 131 is turned off before the time t3. Thus, the output from the sampling latch circuit 5 is constantly on the low level before the time t3. On the other had, in a period from the time t3 to the time t4, data obtained by inverting the digital gradation data is outputted from the sampling latch circuit 5.

Although the above has explained the example in which both of the digital gradation date and its inverted data are fetched into the memory circuit 120 in the sampling latch circuit 5 illustrated in FIG. 17, only one of these data may be fetched. As a result, one of the transistors 125 and 126 and one of the NOR circuits 127 and 128 shown in FIG. 17 can be respectively omitted, and the circuit structure can be simplified.

In the above-described embodiment, the example in which the data latch circuit according to the present invention is used as the signal line drive circuit of the liquid crystal display has been described, it can be also applied to a use other than the signal line drive circuit, for example, the shift register 11 in the scanning line drive circuit and the like.

In each of the above-described embodiments, description has been given as to the example in which the display resolution of 144×176 pixels is provided, the present invention can be similarly applied to any other display resolution.

Further, in each of the above-described embodiments, although the example in which every six signal lines are driven has been explained, the present invention does not restrict the number of signal lines to be driven.

What is claimed is:

1. A data latch circuit comprising:

a memory circuit which has first and second inverters having one output terminal connected to the other input terminal and the other output terminal connected to one input terminal and stores therein digital data which is a latch target;

first and second switch devices configured to switch and controlling whether a power supply voltage is supplied to said first and second inverters;

a third switch device configured to switch and controlling whether said digital data is inputted to said memory circuit; and an output circuit configured to read digital data stored in said memory circuit, said first and second switch devices being turned on in a period other than a cyclic sampling period to supply a power supply voltage to said first and second inverters, said third switch device being turned on in said sampling period to input digital data to said memory circuit, said output circuit having a passing electric current prevention unit which prevents a passing electric current to flow from a power supply terminal of said output terminal to a group terminal in said sampling period.

2. The data latch circuit according to claim 1, wherein said output circuit outputs a signal having predetermined logic in said sampling period, and inverts and outputs data stored in said memory circuit in a period other than said sampling period.

3. The data latch circuit according to claim 2, wherein said output circuit includes:

a first logical operation circuit which outputs a signal having predetermined logic in said sampling period, and inverts and outputs an output from said first inverter in a period other than said sampling period; and a second logical operation circuit which outputs a signal having predetermined logic in said sampling period, and inverts and outputs an output from said second inverter in a period other than said sampling period.

4. The data latch circuit according to claim 3, wherein said first and second logical operation circuits include any one of an NAND gate, an NOR gate and a clocked inverter.

5. The data latch circuit according to claim 2, wherein to said output circuit are supplied a first signal indicating whether or not to be said sampling period and a second signal which has specific logic in a predetermined period other than said sampling period, and said output circuit including:

a first logical operation circuit which outputs a signal having predetermined logic in said sampling period, and inverts and outputs an output from said first inverter when said second signal has said specific logic in a period other than said sampling period; and a second logical operation circuit which outputs a signal having predetermined logic in said sampling period, and inverts and outputs an output from said second inverter when said second signal has said specific logic in a period other than said sampling period.

6. The data latch circuit according to claim 5, wherein said first and second logical operation circuits include any one of an NAND gate, an NOR gate and a clocked inverter.

7. A liquid crystal display comprising:

signal lines and scanning lines being aligned;

display elements arranged in the vicinity of an intersection of said signal line and said scanning line;

a signal line drive circuit configured to drive each of said signal lines; and a scanning line drive circuit configured to drive each of said scanning lines, said signal line dive circuit including:

a shift register which has a plurality of register circuits and sequentially outputs shift register shift pulses shifted in synchronization with a clock signal;

a plurality of data latch circuits configured to latch digital data concerning pixel information in synchronization with each of said shift pulses;

a load latch circuit configured to simultaneously latch outputs from a plurality of said data latch circuits in synchronization with a load signal; and a D/A converter circuit configured to convert a latch output from said load latch circuit into an analog pixel voltage to be then supplied to a corresponding signal line, each of a plurality of said data latch circuits including:

a memory circuit which has first and second inverters having one output and being connected to the other input terminal and the other output terminal being connected to one input terminal, and stores therein digital data which is a latch target;

first and second switch devices configured to switch and controlling whether a power supply voltage is supplied to said first and second inverters;

a third switch device configured to switch and controlling whether said digital data is inputted to said memory circuit; and an output circuit configured to read digital data stored in said memory circuit, said first and second switch devices being turned on in a period other than a cyclic sampling period to supply a power supply voltage to said first and second inverters, said third switch device being turned on in said sampling period to input digital data to said memory circuit, said output circuit having a passing electric current prevention unit which prevents a passing electric current to flow from a power supply terminal of said output terminal to a group terminal in said sampling period.

8. The data latch circuit according to claim 7, wherein said output circuit includes:

a first logical operation circuit which outputs a signal having predetermined logic in said sampling period, and inverts and outputs an output from said first inverter in a period other than said sampling period; and a second logical operation circuit which outputs a signal having predetermined logic in said sampling period, and inverts and outputs an output from said second inverter in a period other than said sampling period, said first and second logical operation circuits being constituted by circuits which are equivalent to each other.

* * * * *